US009774081B2

(12) United States Patent
Su et al.

(10) Patent No.: US 9,774,081 B2
(45) Date of Patent: Sep. 26, 2017

(54) SWITCHABLE ANTENNA

(71) Applicant: Wistron NeWeb Corporation, Hsinchu (TW)

(72) Inventors: Chi-Kang Su, Hsinchu (TW); Cheng-Geng Jan, Hsinchu (TW)

(73) Assignee: Wistron NeWeb Corporation, Hsinchu (TW)

( * ) Notice: Subject to any disclaimer, the term of this patent is extended or adjusted under 35 U.S.C. 154(b) by 352 days.

(21) Appl. No.: 14/605,982

(22) Filed: Jan. 26, 2015

(65) Prior Publication Data

US 2015/0288064 A1 Oct. 8, 2015

(30) Foreign Application Priority Data

Apr. 7, 2014 (TW) ..... 103112732 A

(51) Int. Cl.

| | |
|---|---|
| ***H01Q 3/44*** | (2006.01) |
| ***H01Q 3/24*** | (2006.01) |
| ***H01Q 19/17*** | (2006.01) |
| ***H01Q 21/20*** | (2006.01) |

(52) U.S. Cl.

CPC ..... *H01Q 3/24* (2013.01); *H01Q 19/17* (2013.01); *H01Q 21/205* (2013.01)

(58) Field of Classification Search

CPC ..... H01Q 13/02; H01Q 15/24; H01Q 19/08; H01Q 21/0037

See application file for complete search history.

(56) References Cited

U.S. PATENT DOCUMENTS

| | | | | |
|---|---|---|---|---|
| 2006/0038738 | A1* | 2/2006 | Shtrom | H01Q 3/24 343/876 |
| 2006/0192720 | A1* | 8/2006 | Shtrom | H01Q 1/38 343/795 |
| 2007/0001915 | A1 | 1/2007 | Kono | |
| 2008/0136729 | A1* | 6/2008 | Kang | H04B 1/18 343/861 |
| 2012/0309326 | A1 | 12/2012 | Maguire | |
| 2014/0063345 | A1 | 3/2014 | Chen | |

(Continued)

FOREIGN PATENT DOCUMENTS

| | | |
|---|---|---|
| TW | 201114107 | 4/2011 |
| TW | 201411932 | 3/2014 |

*Primary Examiner* — Dameon E Levi
*Assistant Examiner* — David Lotter
(74) *Attorney, Agent, or Firm* — Winston Hsu

(57) ABSTRACT

A switchable antenna includes a substrate, a first antenna element, a second antenna element, a first switch element, a second switch element, a first radiating portion on an upper surface of the substrate including a first center, a first bend section and a second bend section, and a second radiating portion on an lower surface of the substrate including a second center, a third bend section and a fourth bend section. The third and the fourth bend sections extending from the second center are respectively disposed corresponding to the first and the second bend sections extending from the first center. The first and the second antenna elements on the upper surface are disposed corresponding to the first and the second bend sections. The first and the second switch elements are respectively configured to switch the first and the second antenna elements between a reflector and a parasitic radiating element.

12 Claims, 22 Drawing Sheets

(56) References Cited

U.S. PATENT DOCUMENTS

| | | | | |
|---|---|---|---|---|
| 2014/0361948 | A1* | 12/2014 | Tanaka | H01Q 1/38<br>343/861 |
| 2015/0349418 | A1* | 12/2015 | Patron | H01Q 3/24<br>343/836 |

* cited by examiner

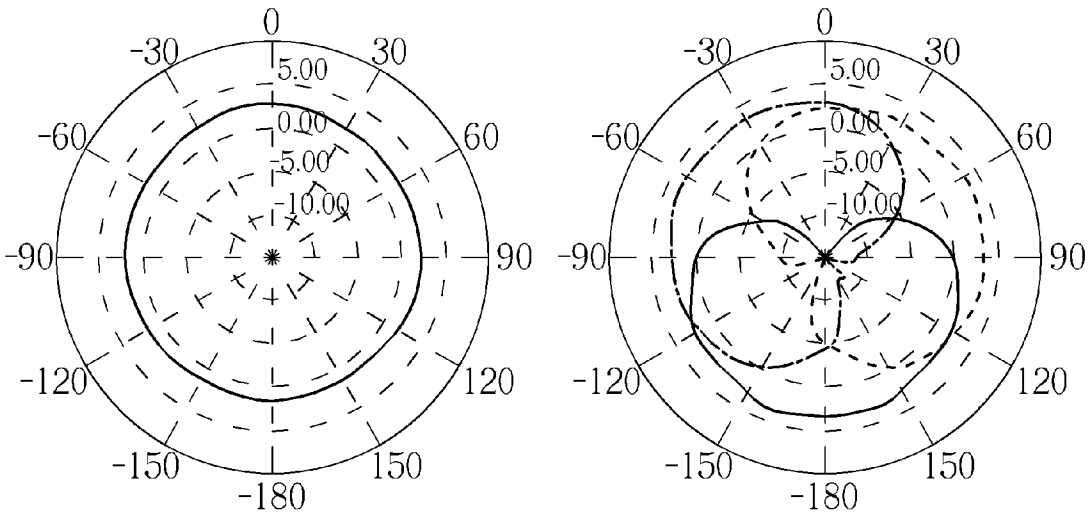
FIG. 3A
FIG. 3B
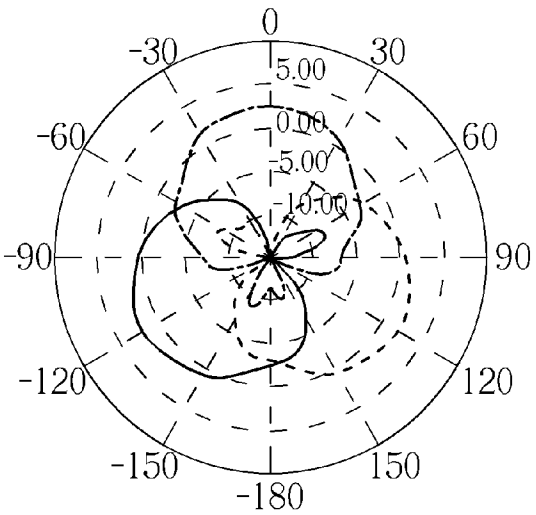
FIG. 3C

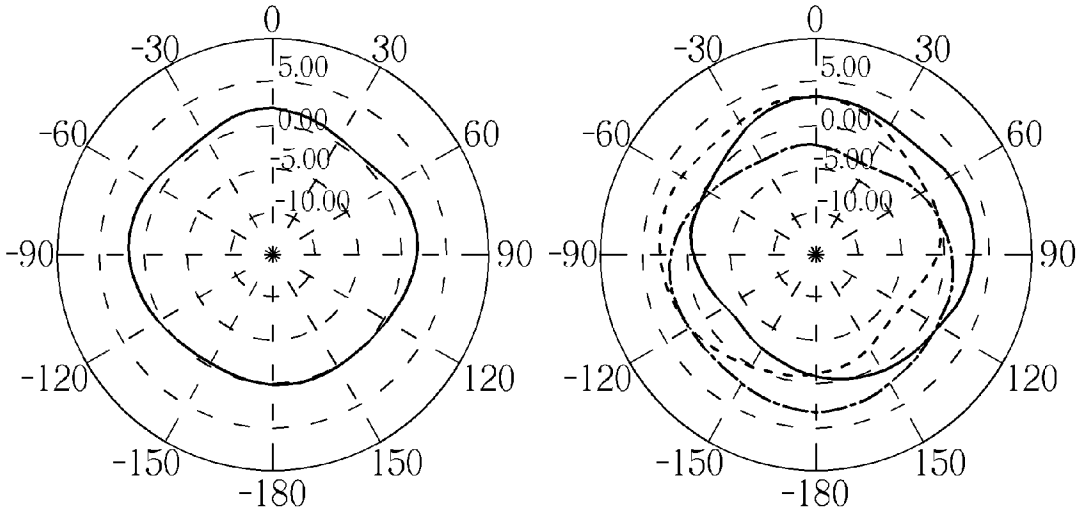
FIG. 8A
FIG. 8B
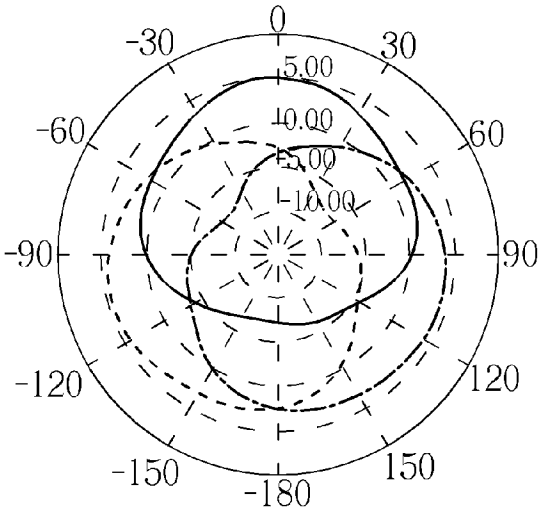
FIG. 8C

SWITCHABLE ANTENNA

BACKGROUND OF THE INVENTION

1. Field of the Invention

The present invention relates to a switchable antenna, and more particularly, to a switchable antenna able to reduce interference, eliminate dead zones, and switch between an omnidirectional mode and a directional mode.

2. Description of the Prior Art

Antennas are utilized to emit and receive radio-frequency waves, thereby transmitting or exchanging radio-frequency signals. Basically, antennas can be divided into omnidirectional antennas and directional antennas according to radiation patterns. Omnidirectional antennas do not need to be pointed and provide equal coverage in all directions. Directional antennas point energy toward a specific direction for concentration within a targeted area, and hence are ideal to increase transmission efficiency covering specific area.

In general, directivity of an antenna is determined after the antenna has been designed. However, it is preferable to operate an antenna in different modes. Namely, it is a common goal in the industry to efficiently switch an electronic product between an omnidirectional mode and a directional mode.

SUMMARY OF THE INVENTION

Therefore, the present invention provides a switchable antenna able to switch between an omnidirectional mode and a directional mode, reduce interference, and eliminate dead zones.

An embodiment of the invention provides a switchable antenna, configured to transmit and receive radio-frequency signals, comprising a substrate comprising an upper surface and a lower surface; a first radiating portion formed on the upper surface of the substrate and comprising a first center, a first bend section and a second bend section respectively extending from the first center; a second radiating portion formed on the lower surface of the substrate and comprising a second center, a third bend section and a fourth bend section respectively extending from the second center, wherein the third bend section and the fourth bend section are disposed corresponding to the first bend section and the second bend section, respectively; a first antenna element disposed on the upper surface and corresponding to the first bend section; a first switch element electrically connected to the first antenna element and configured to switch the first antenna element between a reflector and a parasitic radiating element; a second antenna element disposed on the upper surface and corresponding to the second bend section; and a second switch element electrically connected to the second antenna element and configured to switch the second antenna element between a reflector and a parasitic radiating element.

Another embodiment of the invention further provides a switchable antenna configured to transmit and receive radio-frequency signals, comprising a substrate comprising an upper surface and a lower surface; a first radiating portion formed on the upper surface of the substrate and comprising a first bend section and a second bend section; a second radiating portion formed on the lower surface of the substrate and comprising a center; a third bend section extending from the center and electrically connected to the first bend section through a first via and disposed corresponding to the first bend section; and a fourth bend section extending from the center and electrically connected to the second bend section through a second via and disposed corresponding to the second bend section; a first switch element configured to control a connection between the first bend section and a radio signal processing module; and a second switch element configured to control a connection between the second bend section and the radio signal processing module.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 3A is a schematic diagram illustrating antenna pattern characteristic simulation results for the switchable antenna of FIG. 1A operated at 5500 MHz and calculated at 60 degrees with the switch elements all turned off.

FIG. 3B is a schematic diagram illustrating antenna pattern characteristic simulation results for the switchable antenna of FIG. 1A operated at 5500 MHz and calculated at 60 degrees with merely one of the switch elements turned on.

FIG. 3C is a schematic diagram illustrating antenna pattern characteristic simulation results for the switchable antenna of FIG. 1A operated at 5500 MHz and calculated at 60 degrees with merely one of the switch elements turned off.

FIG. 4B is a schematic diagram illustrating antenna pattern characteristic measurement results for the switchable antenna of FIG. 1A measured at 60 degrees with merely one of the switch elements turned on.

FIG. 5D is a schematic diagram illustrating an equivalent circuit, which the switchable antenna of FIG. 5A may be modeled as.

FIG. 8A is a schematic diagram illustrating antenna pattern characteristic simulation results for the switchable antenna of FIG. 5A operated at 2450 MHz and calculated at 60 degrees with the switch elements all turned on.

FIG. 8B is a schematic diagram illustrating antenna pattern characteristic simulation results for the switchable antenna 50 operated at 2450 MHz and calculated at 60 degrees with merely one of the switch elements 532, 534, 536 turned off.

FIG. 8C is a schematic diagram illustrating antenna pattern characteristic simulation results for the switchable antenna of FIG. 5A operated at 2450 MHz and calculated at 60 degrees with merely one of the switch elements turned on.

FIG. 9C is a schematic diagram illustrating antenna pattern characteristic measurement results for the switchable antenna of FIG. 5A measured at 60 degrees with merely one of the switch elements turned on.

DETAILED DESCRIPTION

Figure 1A:
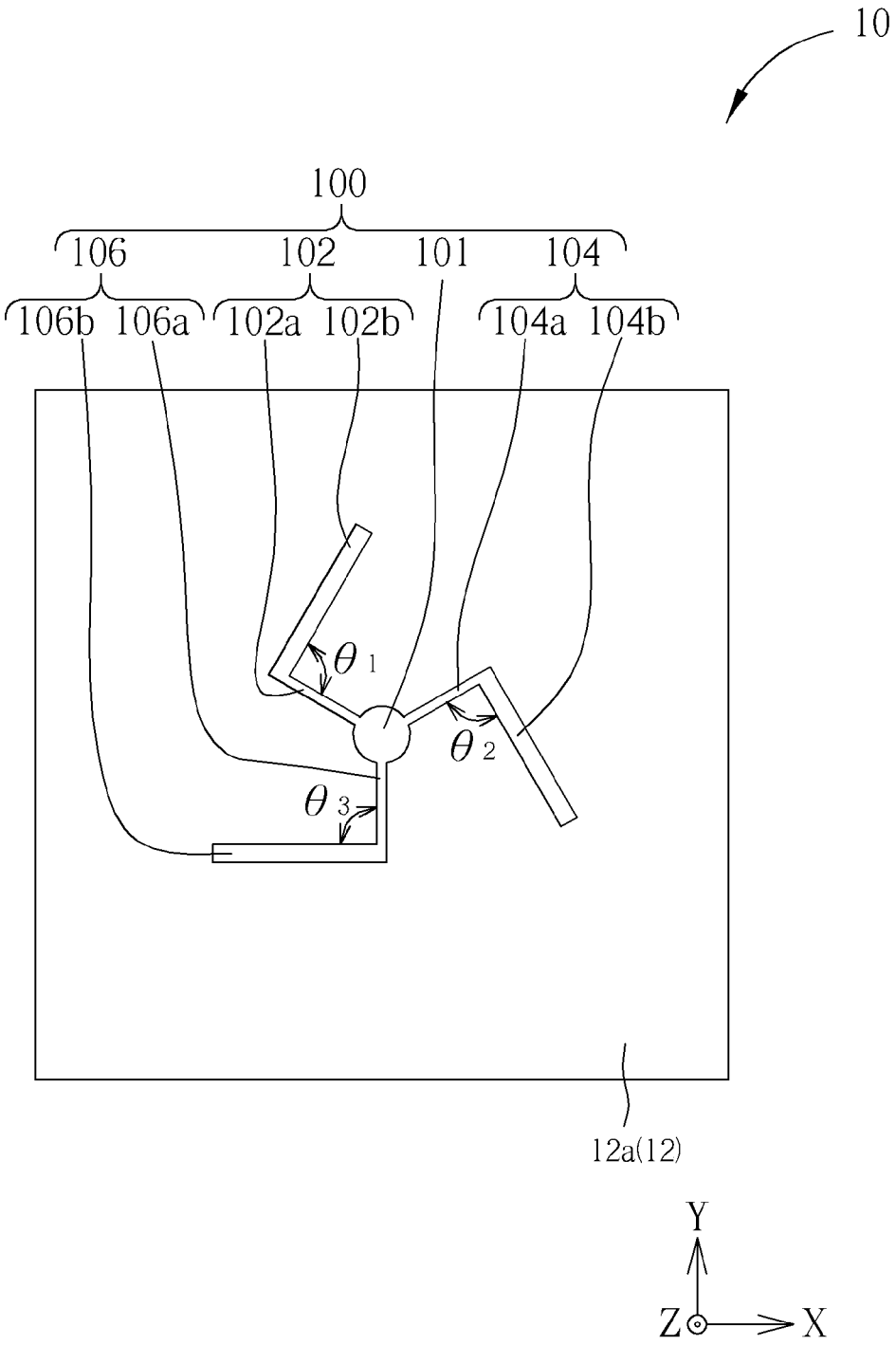
FIGS. 1A and 1B are schematic diagrams respectively illustrating a top view of a front surface and a back surface of a switchable antenna according to an embodiment of the present invention.
Figure 1B:
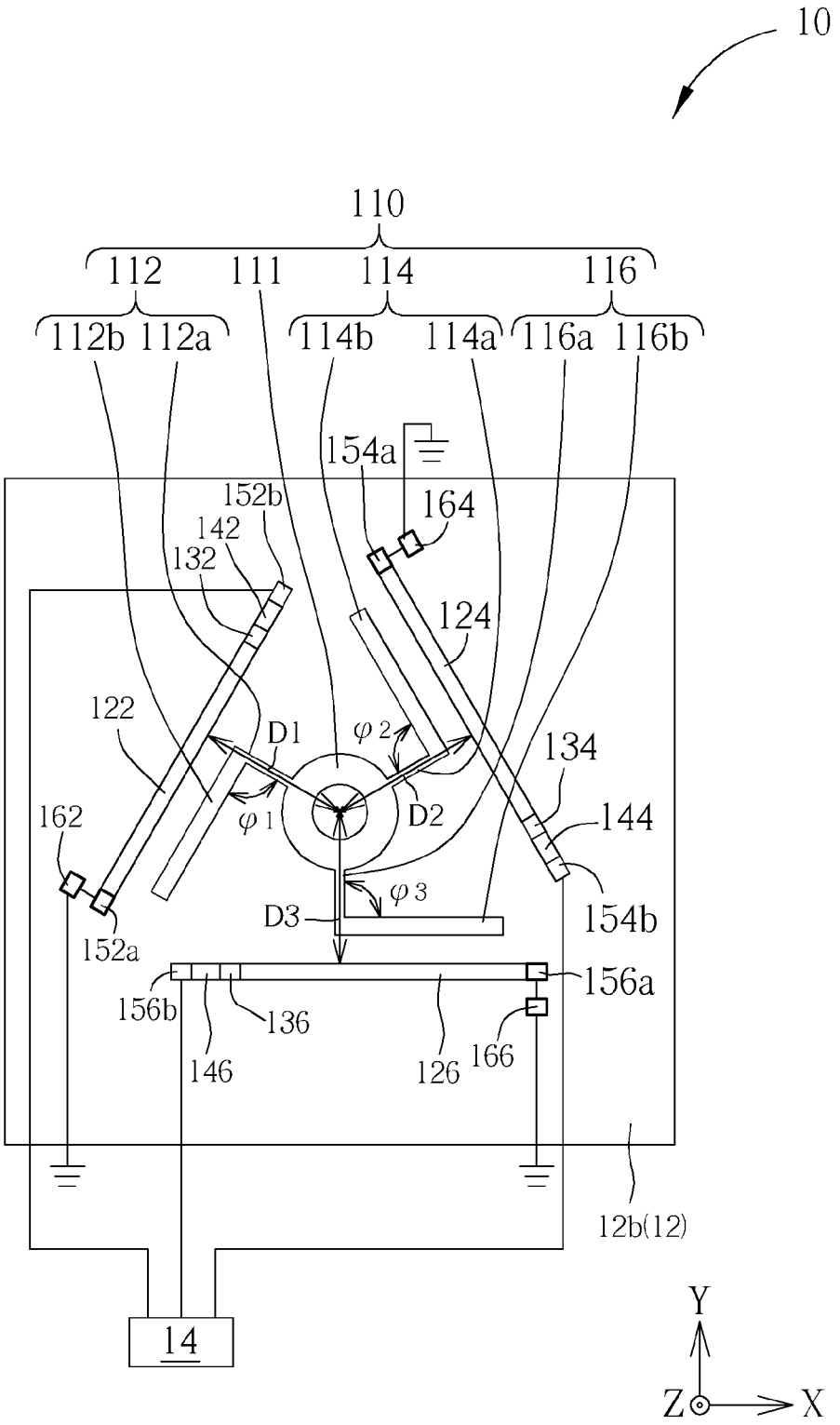
Figure 1C:
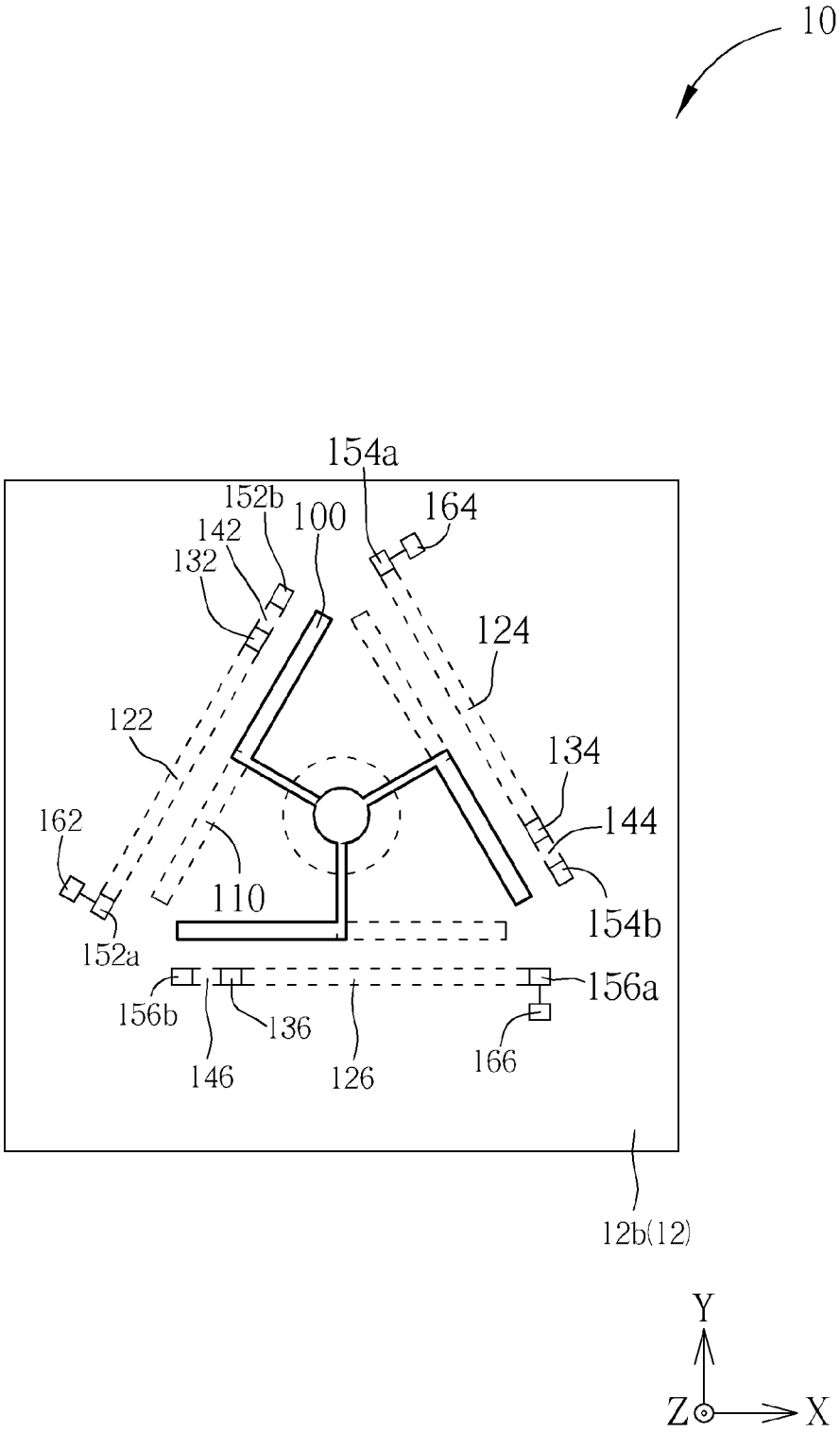
FIG. 1C is a schematic diagram illustrating a perspective view of the switchable antenna of FIG. 1A.
Figure 1E:
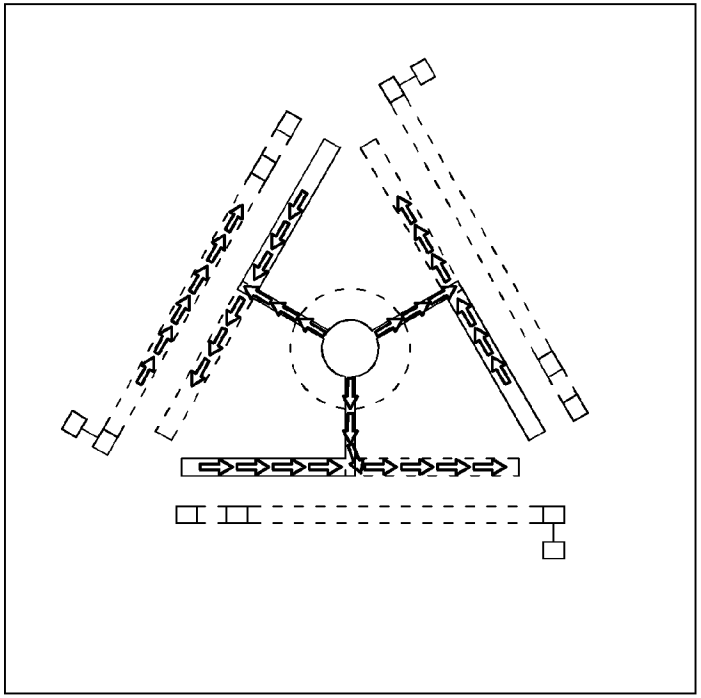
FIGS. 1D and 1E are schematic diagrams respectively illustrating current distribution of the switchable antenna of FIG. 1A operated in an omnidirectional mode and a directional mode.
Figure 1D:
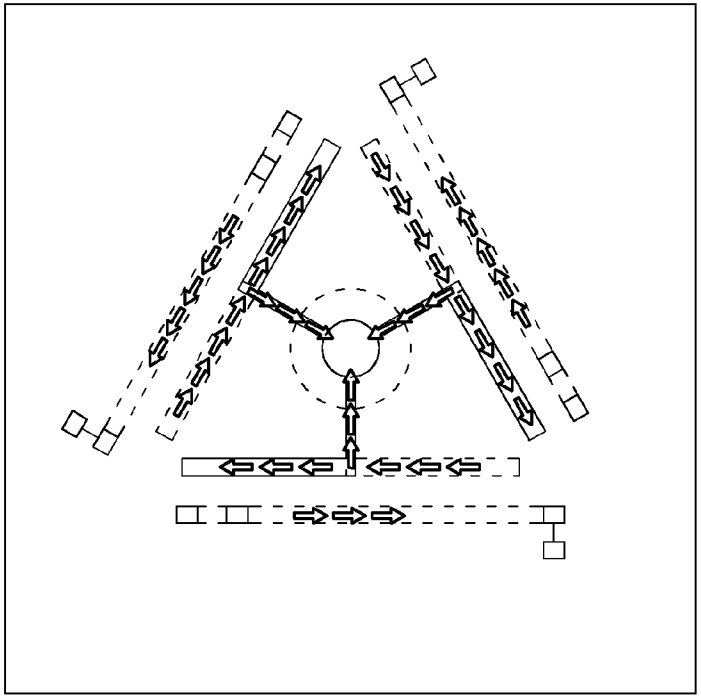

Please refer to FIGS. 1A to 1E. FIGS. 1A and 1B are schematic diagrams respectively illustrating a top view of a front surface and a back surface of a switchable antenna 10 according to an embodiment of the present invention. FIG. 1C is a schematic diagram illustrating a perspective view of the switchable antenna 10. FIGS. 1D and 1E are schematic diagrams respectively illustrating current distribution of the switchable antenna 10 operated in an omnidirectional mode and a directional mode. As shown in FIGS. 1A to 1C, the switchable antenna 10 may be adapted to a wireless local area network (such as IEEE 802.11 wireless local area network) to transmit and receive radio-frequency signals. The switchable antenna 10 comprises a substrate 12, radiating portions 100, 110, antenna elements 122, 124, 126, switch elements 132, 134, 136, extension sections 142, 144, 146, chokes 152*a*, 152*b*, 154*a*, 154*b*, 156*a*, 156*b*, and resistors 162, 164, 166. The radiating portion 100 is formed on an upper surface 12*a* of the substrate 12 and comprises a center 101 and upper surface bend sections 102, 104, 106 extending from the center 101. The radiating portion 110 is formed on a lower surface 12*b* of the substrate 12 and comprises a center 111 and lower surface bend sections 112, 114, 116 extending from the center 111. One end of the antenna elements 122, 124, 126 is respectively coupled to a control module 14, which is used for providing direct-current (DC) power through the switch elements 132, 134, 136 and the extension sections 142, 144, 146; the other end of the antenna elements 122, 124, 126 is grounded through the resistors 162, 164, 166, respectively. Therefore, when the control module 14 respectively turns on the switch elements 132, 134, 136, the antenna elements 122, 124, 126 would respectively serve as a reflector; when the control module 14 respectively turns off the switch elements 132, 134, 136, the antenna element 122, 124, 126 would respectively serve as a parasitic radiating element. The chokes 152*a*, 154*a*, 156*a* are respectively coupled between a system ground and the antenna elements 122, 124, 126, and the chokes 152*b*, 154*b*, 156*b* are respectively coupled between the control module 14 and the antenna elements 122, 124, 126 in order to limit the resonating radio-frequency signals in the antenna elements 122, 124, 126 and in order to prevent radio-frequency signals from interfering the control module 14.

In brief, by controlling the switch elements 132, 134, 136, the antenna elements 122, 124, 126 can respectively switch between a reflector and a parasitic radiating element, such that the switchable antenna 10 can be operated in an omnidirectional mode or a directional mode, and directivity of the switchable antenna 10 can be adjusted to avoid interference.

Specifically, when all of the switch elements 132, 134, 136 are switched off, the antenna elements 122, 124, 126 would respectively serve as a parasitic radiating element to increase bandwidth. In such a situation, the switchable antenna 10 enters an omnidirectional mode to transmit and receive radio-frequency signals in all directions for detecting and searching stations or other operation requirements. When one of the switch elements 132, 134, 136 (such as the switch element 136) is turned on, the corresponding one of the antenna elements 122, 124, 126 (i.e., the antenna element 126) becomes a reflector, while the other the antenna elements still serve as a parasitic radiating element (i.e., the antenna elements 122, 124), respectively. Accordingly, the switchable antenna 10 changes into a directional mode such that radio-frequency signals are transmitted or received along a specific direction (for example, toward a direction Y) to increase transmission efficiency and to reduce power consumption. When one of the switch elements 132, 134, 136 (such as the switch element 136) is turned off, the corresponding one of the antenna elements 122, 124, 126 (i.e., the antenna element 126) serve as a parasitic radiating element while the other antenna elements respectively turn into a reflector (i.e., the antenna element 122, 124) in order to enhance directivity of the switchable antenna 10 toward a specific direction (for example, opposite to the direction Y) and in order to avoid interference by means of the transmitted or received radio-frequency signals of narrow beamwidth.

In order to improve quality of radio-frequency signals transmitted or received omnidirectionally, geometric structure of the switchable antenna 10 enables itself to form stable annular currents. Specifically, the upper surface bend section 102 comprises portions 102*a*, 102*b*; the upper surface bend section 104 comprises portions 104*a*, 104*b*; the upper surface bend section 106 comprises portions 106*a*, 106*b*. With an enclosed angle $\theta_1$ of 90 degrees enclosed by the portions 102*a*, 102*b*, an enclosed angle $\theta_2$ of 90 degrees enclosed by the portions 104*a*, 104*b*, and an enclosed angle $\theta_3$ of 90 degrees enclosed by the portions 106*a*, 106*b*, the upper surface bend sections 102, 104, 106 respectively form a L-shaped structure with clockwise bending and are equally spaced apart. Similarly, the lower surface bend section 112 comprises portions 112*a*, 112*b*; the lower surface bend section 114 comprises portions 114*a*, 114*b*; the lower surface bend section 116 comprises portions 116*a*, 116*b*. With an enclosed angle $\phi_1$ of 90 degrees enclosed by the portions 112*a*, 112*b*, an enclosed angle $\phi_2$ of 90 degrees enclosed by the portions 114*a*, 114*b* and an enclosed angle $\phi_3$ of 90 degrees enclosed by the portions 116*a*, 116*b*, the lower surface bend sections 112, 114, 116 respectively form a L-shaped structure with counterclockwise bending and are spaced evenly around. As shown in FIG. 1C, along a vertical projection direction Z, the centers 101 and 111 are aligned and the upper surface bend sections 102, 104, 106 with a L-shaped structure bent clockwise and the lower surface bend section 112, 114, 116 with a L-shaped structure bent counterclockwise respectively form a T-shaped structure. Accordingly, when the switchable antenna 10 transmits radio-frequency signals in an omnidirectional mode, currents flow in the radiating portion 100, 110 clockwise or counterclockwise as shown in FIG. 1D, and hence the switchable antenna 10 can provide Alford loop antenna effect. A null can also occur in the radiation pattern in the vertical projection direction Z by means of geometry features of the switchable antenna 10. Moreover, because of time delay, radio-frequency signals generated from a T-shaped structure of the switchable antenna 10 and radio-frequency signals generated from another T-shaped structure of the switchable antenna 10 add up in phase to enhance the total intensity and to form an omnidirectional radiation pattern.

In order to enhance directivity of the switchable antenna 10, distances D1, D2, D3 respectively between the center 111 and the antenna elements 122, 124, 126 may be in a range of 0.15 to 0.25 times operating wavelength corresponding to the center frequency (i.e., 0.15 times the operating wavelength) to ensure a front-to-back (F/B) ratio of the operating frequency (e.g., 5150 MHz to 5850 MHz) at 60 degrees (i.e., the elevation angle of 30 degrees from XY plane) greater than 5 dB. In other words, antenna resonance mechanism of the switchable antenna 10 functions as an annular antenna and therefore satisfies the requirements that distance between a reflector and a radiator of a Yagi antenna is in a range of 0.15 to 0.25 times the operating wavelength.

Figure 2:
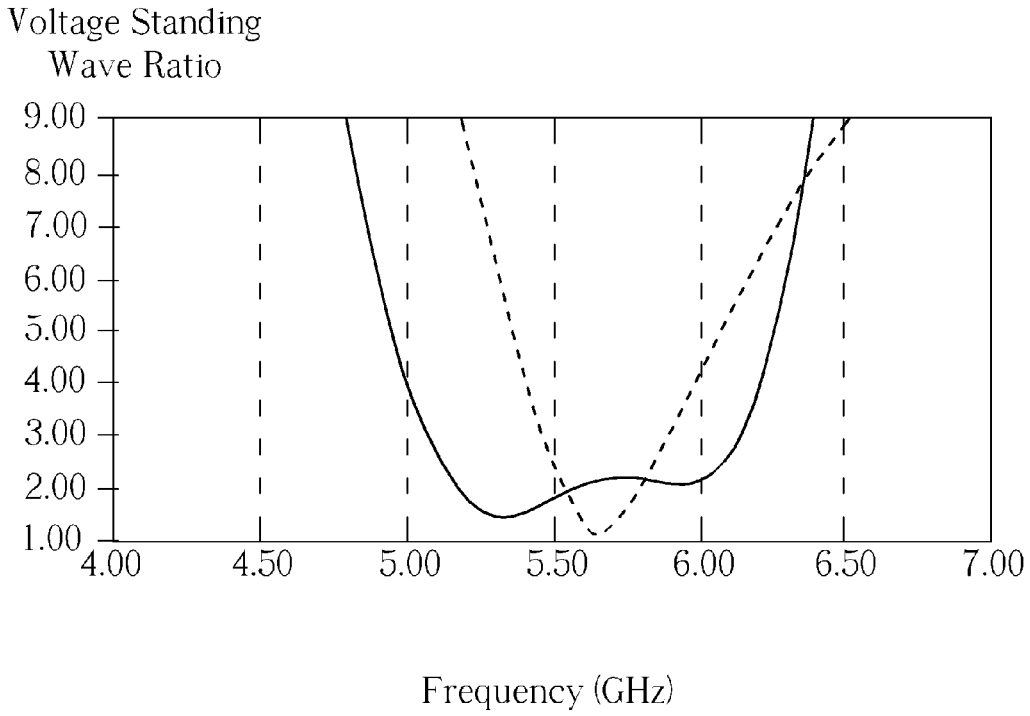
FIG. 2 is a schematic diagram illustrating antenna resonance simulation results of the switchable antenna of FIG. 1A operated in an omnidirectional mode.
Figure 4A:
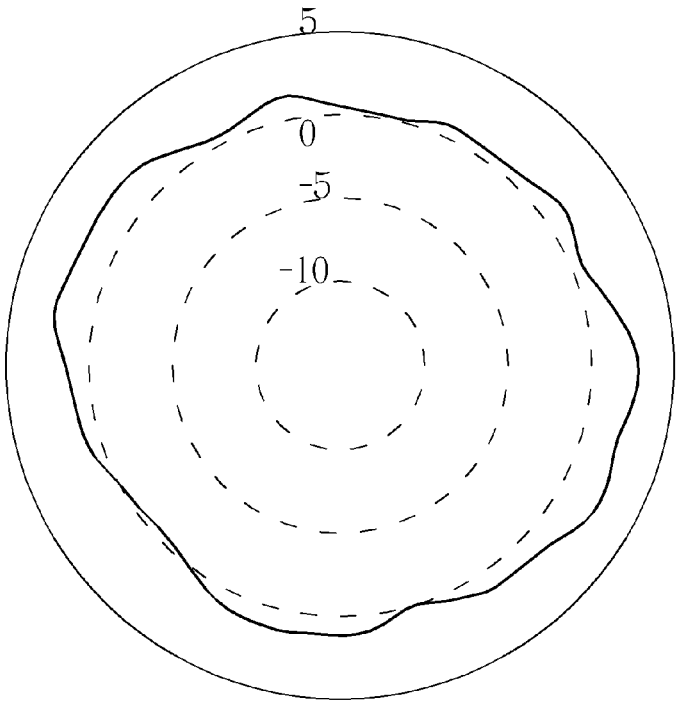
FIG. 4A is a schematic diagram illustrating antenna pattern characteristic measurement results for the switchable antenna of FIG. 1A measured at 60 degrees with the switch elements all turned off.
Figure 4B:
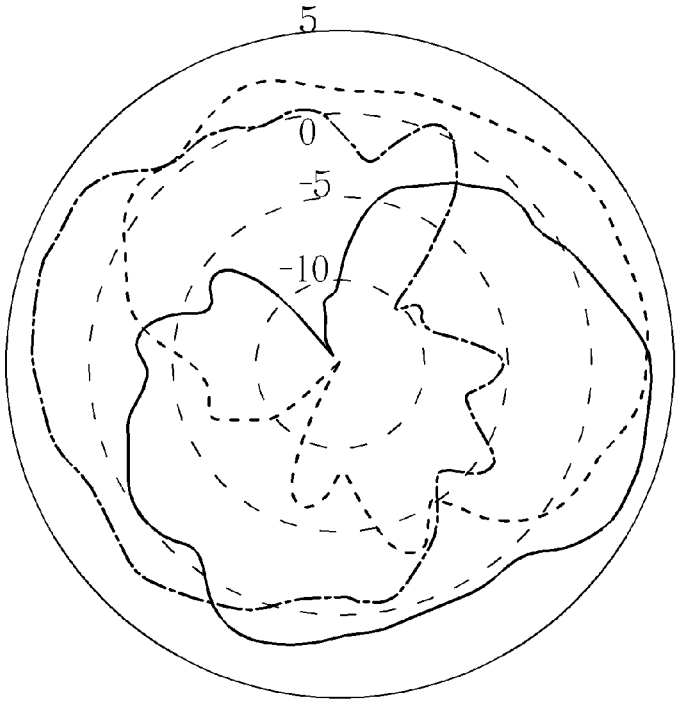

Simulation and measurement may be employed to determine whether radiation pattern of the switchable antenna 10 at different frequencies meets system requirements. Please refer to FIGS. 2 to 4B. FIG. 2 is a schematic diagram illustrating antenna resonance (Voltage Standing Wave Ratio, VSWR) simulation results of the switchable antenna 10 operated in an omnidirectional mode. In FIG. 2, antenna resonance simulation results of the switchable antenna 10 without the antenna elements 122, 124, 126 are presented by a dotted line, and antenna isolation simulation results of the switchable antenna 10 with the antenna elements 122, 124, 126 are presented by a solid line. As shown in FIG. 2, the antenna elements 122, 124, 126 of the switchable antenna 10 can effectively broaden bandwidth. In practical application, a vast metal plate is usually disposed below the switchable antenna 10 to provide shielding or other functions. However, the vast metal plate would cause the radiation pattern of the switchable antenna 10 to shift upward and thus generate a tilt angle. In order to properly present characteristics of the switchable antenna 10, the switchable antenna 10 can be sampled at 60 degrees (i.e., the elevation angle of 30 degrees from XY plane). FIG. 3A is a schematic diagram illustrating antenna pattern characteristic simulation results for the switchable antenna 10 operated at 5500 MHz and calculated at 60 degrees with the switch elements 132, 134, 136 all turned off. FIG. 3B is a schematic diagram illustrating antenna pattern characteristic simulation results for the switchable antenna 10 operated at 5500 MHz and calculated at 60 degrees with merely one of the switch elements 132, 134, 136 turned on. FIG. 3C is a schematic diagram illustrating antenna pattern characteristic simulation results for the switchable antenna 10 operated at 5500 MHz and calculated at 60 degrees with merely one of the switch elements 132, 134, 136 turned off. FIG. 4A is a schematic diagram illustrating antenna pattern characteristic measurement results for the switchable antenna 10 measured at 60 degrees with the switch elements 132, 134, 136 all turned off. FIG. 4B is a schematic diagram illustrating antenna pattern characteristic measurement results for the switchable antenna 10 measured at 60 degrees with merely one of the switch elements 132, 134, 136 turned on. As shown in FIG. 3A to 4B, when the number of the switch elements turned on grows the beamwidth is less divergent.

Figure 5A:
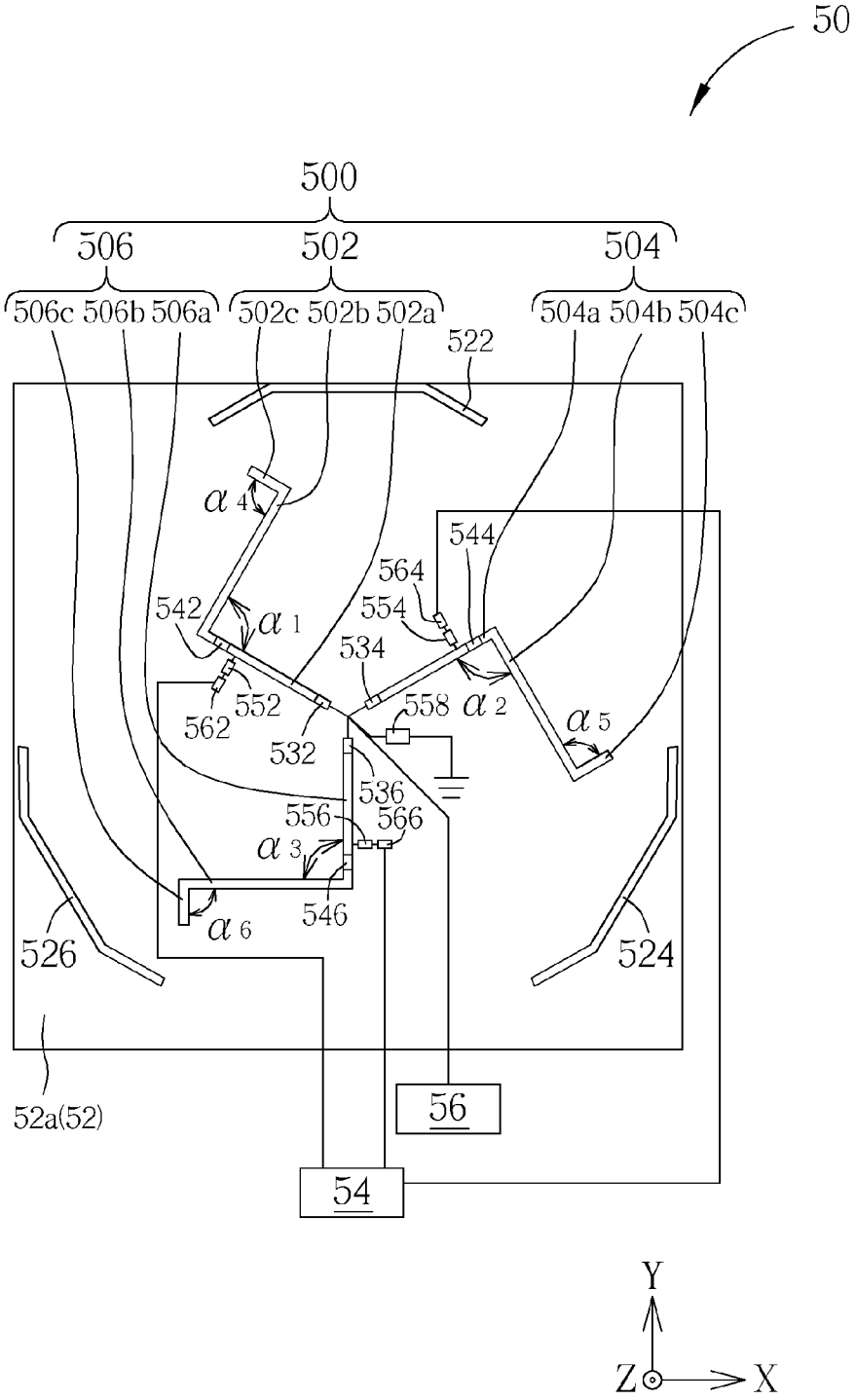
FIGS. 5A and 5B are schematic diagrams respectively illustrating a top view of a front surface and a back surface of a switchable antenna according to an embodiment of the present invention.
Figure 5B:
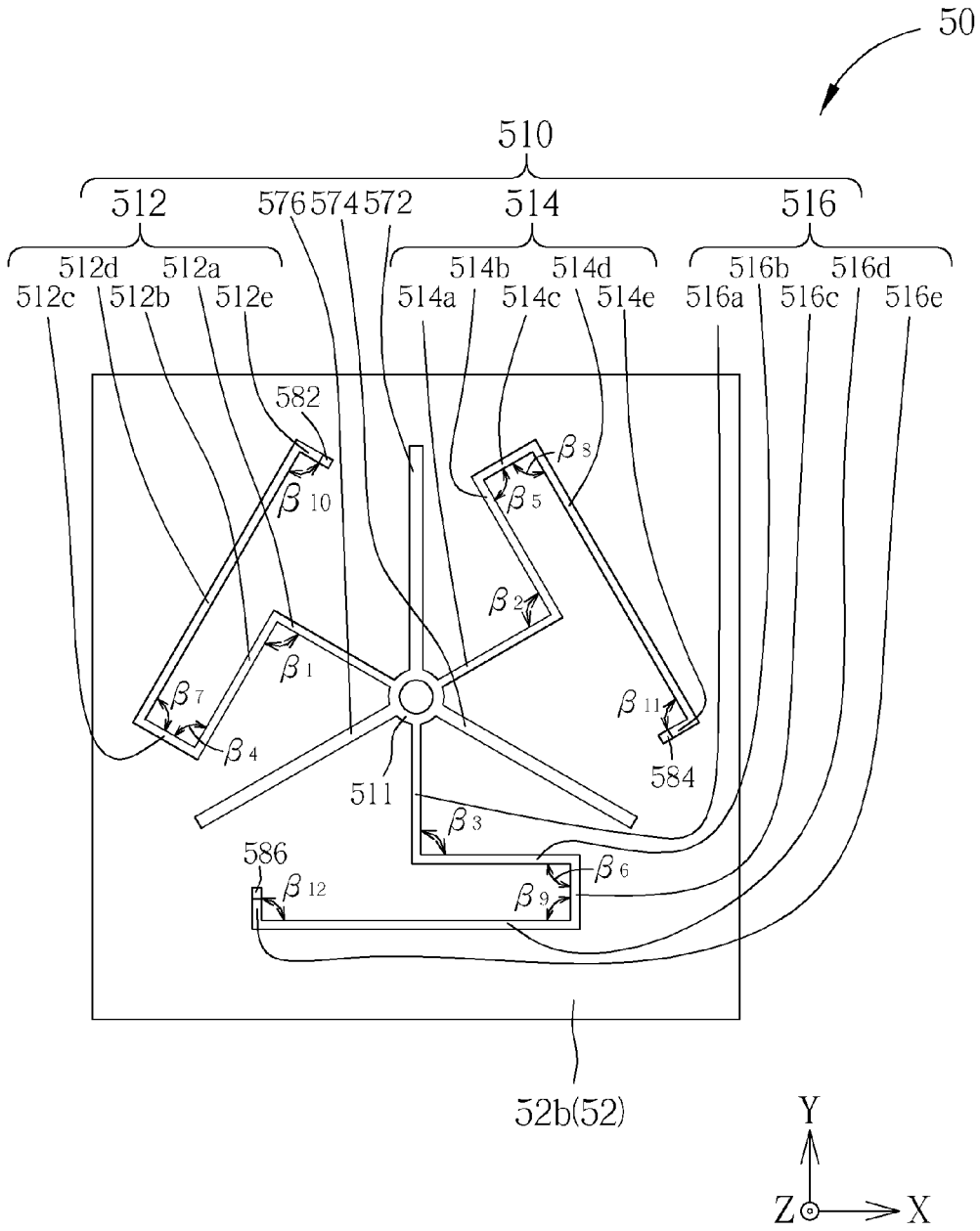
Figure 5C:
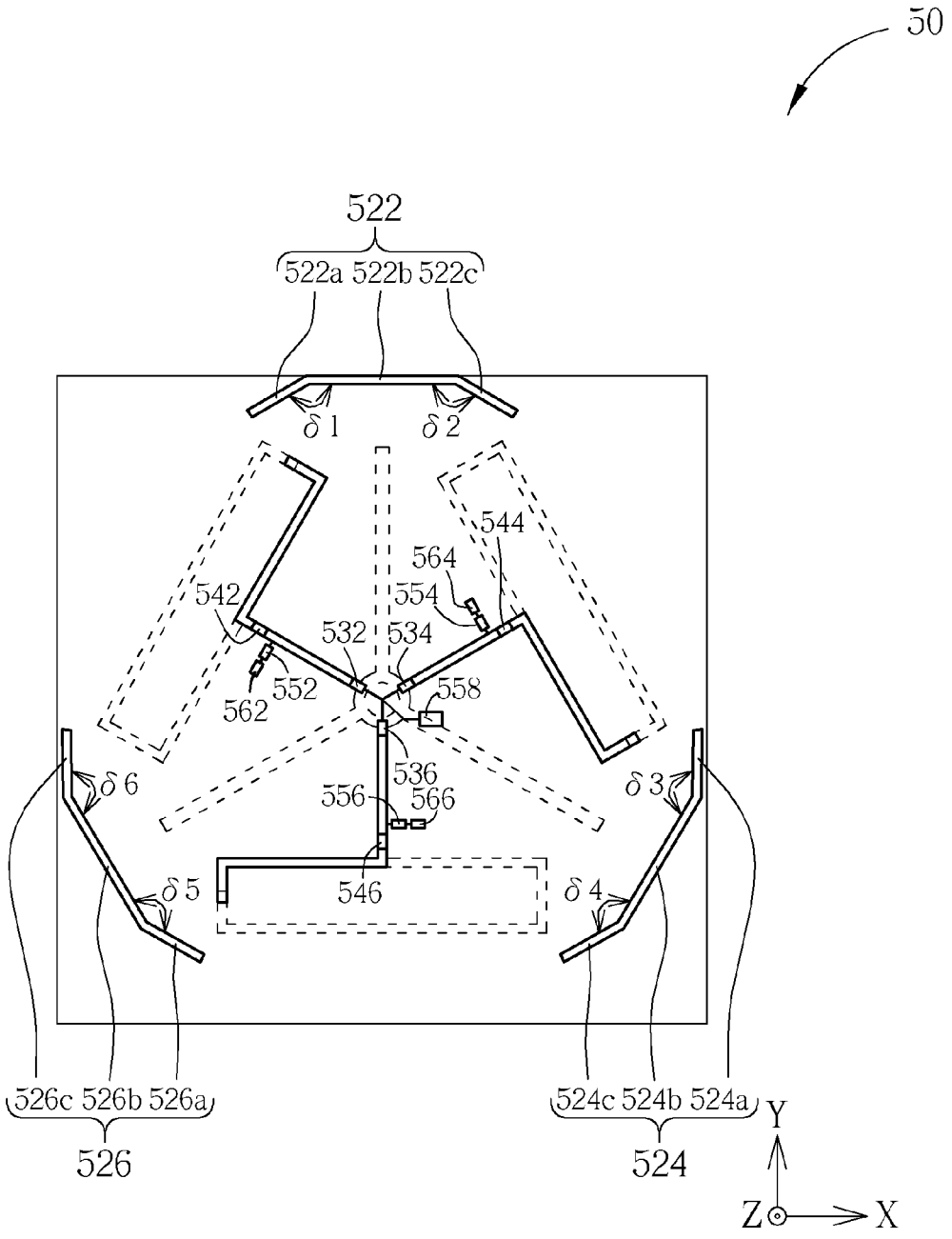
FIG. 5C is a schematic diagrams illustrating a perspective view of the switchable antenna of FIG. 5A.
Figure 5D:
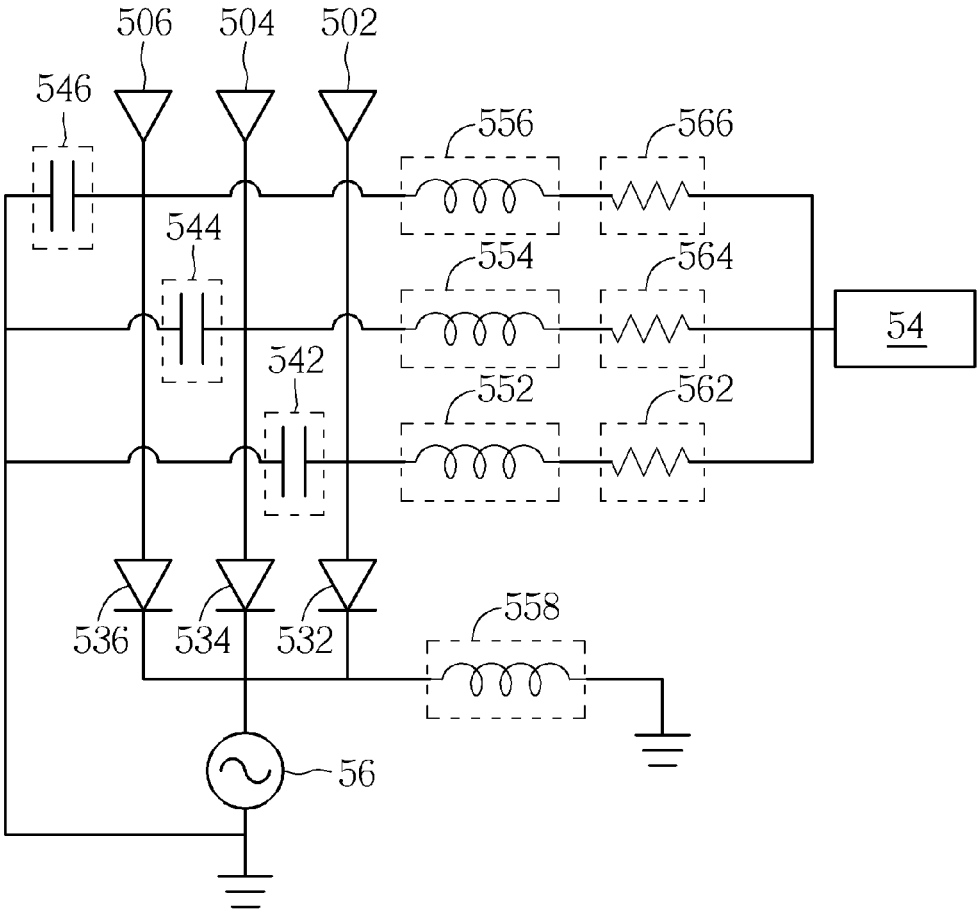

On the other hand, please refer to FIGS. 5A to 5D. FIGS. 5A and 5B are schematic diagrams respectively illustrating a top view of a front surface and a back surface of a switchable antenna 50 according to an embodiment of the present invention. FIG. 5C is a schematic diagrams illustrating a perspective view of the switchable antenna 50. FIG. 5D is a schematic diagram illustrating an equivalent circuit, which the switchable antenna 50 may be modeled as. As shown in FIGS. 5A to 5C, the switchable antenna 50 may be adapted to a wireless local area network (such as IEEE 802.11 wireless local area network) to transmit and receive radio-frequency signals as well. The switchable antenna 50 comprises a substrate 52, radiating portions 500, 510, adjustment elements 522, 524, 526, switch elements 532, 534, 536, direct current blocks 542, 544, 546, chokes 552, 554, 556, 558, and resistor 562, 564, 566. The radiating portion 500 is formed on an upper surface 52*a* of the substrate 52 and comprises upper surface bend sections 502, 504, 506. The radiating portion 510 is formed on a lower surface 52*b* of the substrate 52 and comprises a center 511 and lower surface bend sections 512, 514, 516, reflection sections 572, 574, 576 and vias 582, 584, 586 extending from the center 511. The lower surface bend sections 512, 514, 516 correspond to the upper surface bend sections 502, 504, 506, and are electrically connected to the upper surface bend sections 502, 504, 506 through the vias 582, 584, 586 which are disposed in the substrate 52, respectively.

As shown in FIG. 5D, one end of the switch elements 532, 534, 536 is respectively coupled to a radio signal processing module 56 which is used for providing alternating-current (AC) power and is coupled to a system ground through the choke 558; the other end of the switch elements 532, 534, 536 is electrically connected to the upper surface bend sections 502, 504, 506 and is coupled to a control module 54 which is used for providing direct-current (DC) power through the upper surface bend sections 502, 504, 506, the chokes 552, 554, 556 and the resistors 562, 564, 566. Therefore, when the control module 54 respectively turns on the switch elements 532, 534, 536, the upper surface bend sections 502, 504, 506 can be respectively connected to the radio signal processing module 56 so as to transmit and receive radio-frequency signals; when the control module 54 respectively turns off the switch element 532, 534, 536, the upper surface bend sections 502, 504, 506 cannot connect to the radio signal processing module 56. The chokes 552, 554, 556, 558 can limit the resonating radio-frequency signals in the upper surface bend sections 502, 504, 506 and prevent radio-frequency signals from interfering the control module 54. The direct current blocks 542, 544, 546 can prevent DC power in any of the upper surface bend sections 502, 504, 506 (e.g., the upper surface bend section 502) from being transmitted to other upper surface bend sections (e.g., the upper surface bend sections 504, 506) through vias 582, 584, 586. The reflection sections 572, 574, 576 are respectively disposed between two adjacent lower surface bend sections so as to enhance directivity of the switchable antenna 50.

Briefly, by controlling the switch elements 532, 534, 536, the upper surface bend sections 502, 504, 506 can respectively be connected to the radio signal processing module 56, such that the switchable antenna 50 can be operated in an omnidirectional mode or a directional mode. Moreover, with the reflection sections 572, 574, 576, directivity of the switchable antenna 50 can be adjusted to avoid interference.

Specifically, when all of the switch elements 532, 534, 536 are switched on, the upper surface bend sections 502, 504, 506 are respectively connected to the radio signal processing module 56, and the switchable antenna 50 can provide Alford loop antenna effect together with the lower surface bend sections 512, 514, 516 electrically connected. In such a situation, the switchable antenna 50 enters an omnidirectional mode to transmit and receive radio-frequency signals in all directions for detecting and searching stations or other operation requirements. When one of the switch elements 532, 534, 536 (such as the switch element 536) is turned off, only two of the upper surface bend sections (i.e., the upper surface bend sections 502, 504) are still connected to the radio signal processing module 56, and the two upper surface bend sections respectively form a folded dipole antenna structure along with the corresponding lower surface bend section (i.e., the lower surface bend sections 512, 514). Furthermore, with the corresponding reflection sections (i.e., the reflection sections 574, 576), the switchable antenna 50 changes into a directional mode, such that radio-frequency signals are transmitted or received along a specific direction (for example, toward a direction Y) to increase transmission efficiency and to reduce power consumption. When one of the switch elements 532, 534, 536 (such as the switch element 536) is turned on, only one of the upper surface bend sections (i.e., the upper surface bend section 506) is still connected to the radio signal processing module 56, and the upper surface bend section forms a folded dipole antenna structure along with the corresponding lower surface bend section (i.e., the lower surface bend section 516). Also, with the corresponding reflection sections (i.e., the reflection sections 574, 576), directivity of the switchable antenna 50 toward a specific direction (for example, opposite to the direction Y) is enhanced, and the beamwidth of the transmitted or received radio-frequency signals is narrower in order to avoid interference.

In order to improve quality of radio-frequency signals transmitted or received omnidirectionally, geometric structure of the switchable antenna 50 enables itself to form stable annular currents. Specifically, the upper surface bend section 502 comprises portions 502*a*, 502*b*, 502*c*, the upper surface bend section 504 comprises portions 504*a*, 504*b*, 504*c*, and the upper surface bend section 506 comprises portions 506*a*, 506*b*, and 506*c*. With enclosed angles $\alpha_1$ to $\alpha_6$ of 90 degrees enclosed respectively by the portions 502*a* to 506*c*, the upper surface bend sections 502, 504, 506 respectively form a clockwise bending structure and are equally spaced apart. Similarly, the lower surface bend section 512 comprises portions 512*a* to 512*e*, the lower surface bend section 514 comprises portions 514*a* to 514*e*, and the lower surface bend section 516 comprises portions 516*a* to 516*e*. With enclosed angles $\beta_1$ to $\beta_{12}$ of 90 degrees enclosed respectively by the portions 512*a* to 516*e*, the lower surface bend sections 512, 514, 516 respectively form a counterclockwise bending structure and are equally spaced out. As shown in FIG. 5C, the upper surface bend sections 502, 504, 506 and the lower surface bend sections 512, 514, 516 respectively form a closed folded dipole antenna structure along the vertical projection direction Z. In addition, the lower surface bend sections 512, 514, 516 can be electrically connected to the upper surface bend sections 502, 504, 506 through the vias 582, 584, 586. Accordingly, when transmitting radio-frequency signals in an omnidirectional mode, the switchable antenna 50 can generate Alford loop antenna effect.

Figure 6A:
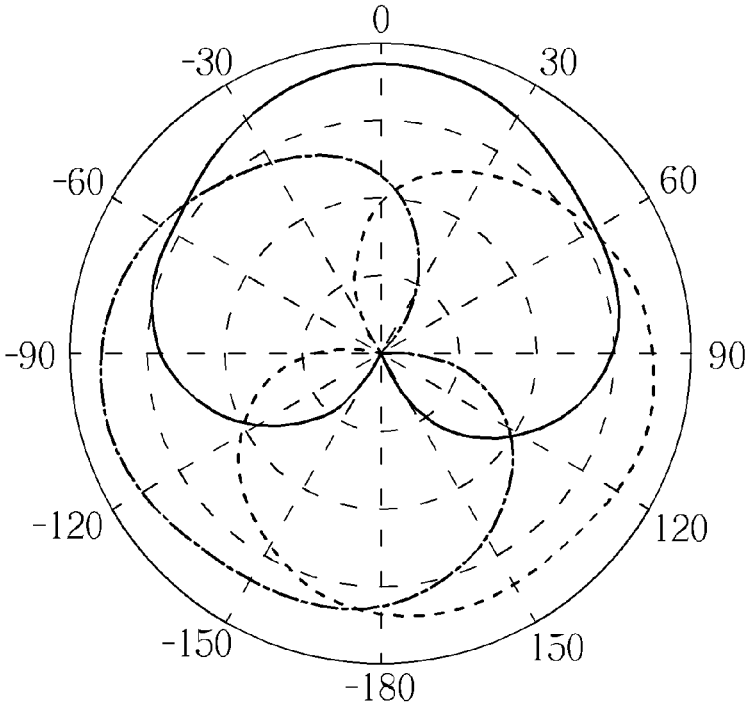
FIG. 6A is a schematic diagram illustrating antenna pattern characteristic simulation results for the switchable antenna of FIG. 5A operated at 2500 MHz with the adjustment elements.
Figure 6B:
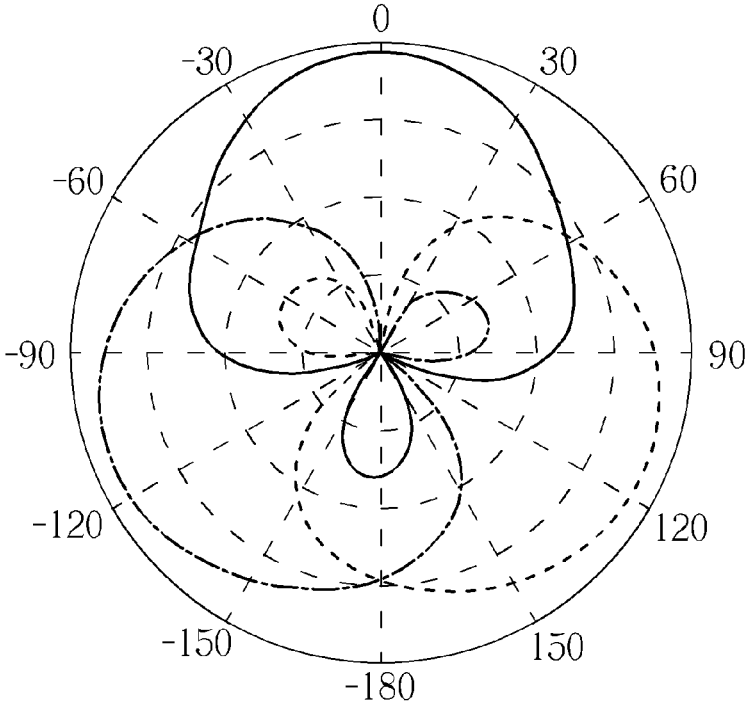
FIG. 6B is a schematic diagram illustrating antenna pattern characteristic simulation results for the switchable antenna of FIG. 5A operated at 2500 MHz without the adjustment elements.

In order to enhance directivity of the switchable antenna 50, the reflection sections 572, 574, 576 are respectively disposed between two adjacent lower surface bend sections and corresponds to the folded dipole antenna structure respectively formed from the upper surface bend sections 502, 504, 506 and the lower surface bend sections 512, 514, 516 so as to provide reflection characteristics as a Yagi antenna. The adjustment element 522 comprises portions 522*a*, 522*b*, 522*c*, the adjustment element 524 comprises portions 524*a*, 524*b*, 524*c*, and the adjustment element 526 comprises portions 526*a*, 526*b*, and 526*c*. With enclosed angles $\delta_1$ to $\delta_6$ enclosed respectively by the portions 522*a* to 526*c*, the adjustment elements 522, 524, 526 respectively corresponding to the reflection sections 572, 574, 576 can form a bow structure and are equally spaced apart, thereby enhancing antenna gain around boundary of radiation pattern under a directional mode. In other words, the adjustment elements 522, 524, 526 can increase beamwidth and therefore eliminate dead zones. Specifically, please refer to FIGS. 6A and 6B. FIG. 6A is a schematic diagram illustrating antenna pattern characteristic simulation results for the switchable antenna 50 operated at 2500 MHz with the adjustment elements 522, 524, 526. FIG. 6B is a schematic diagram illustrating antenna pattern characteristic simulation results for the switchable antenna 50 operated at 2500 MHz without the adjustment elements 522, 524, 526. As shown in FIGS. 6A and 6B, beamwidth of the switchable antenna 50 with the adjustment elements 522, 524, 526 is wider.

Figure 7A:
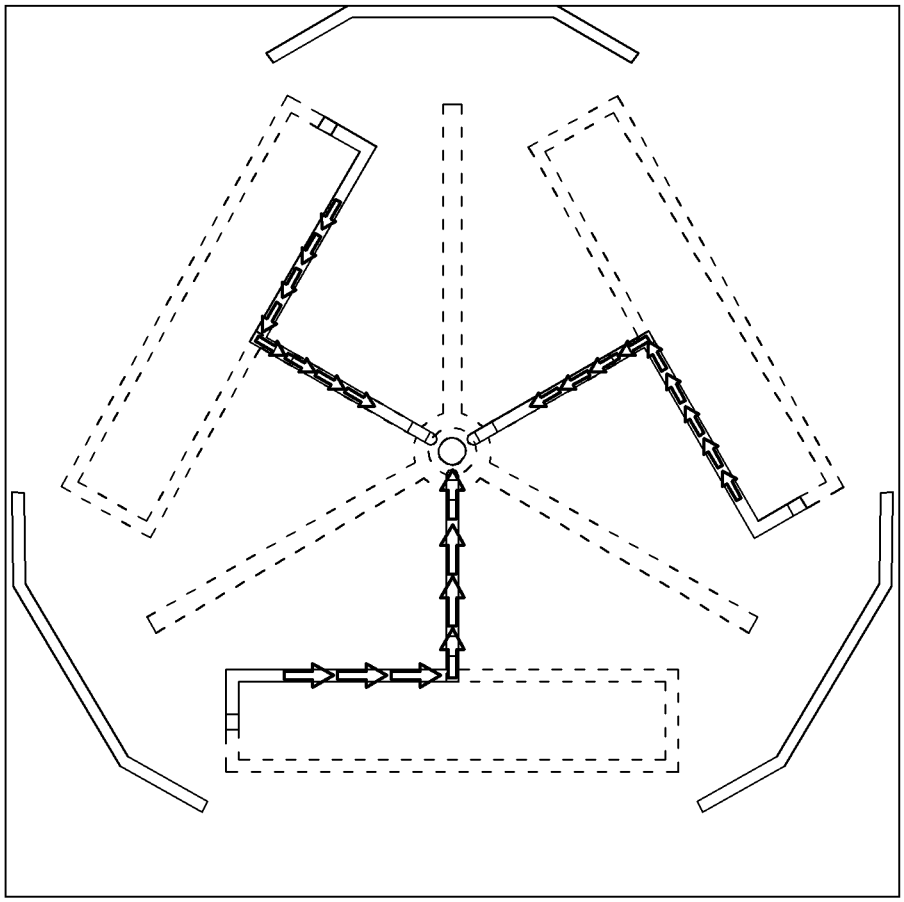
FIG. 7A is a schematic diagram illustrating current distribution of the switchable antenna of FIG. 5A operated in a directional mode.
Figure 7B:
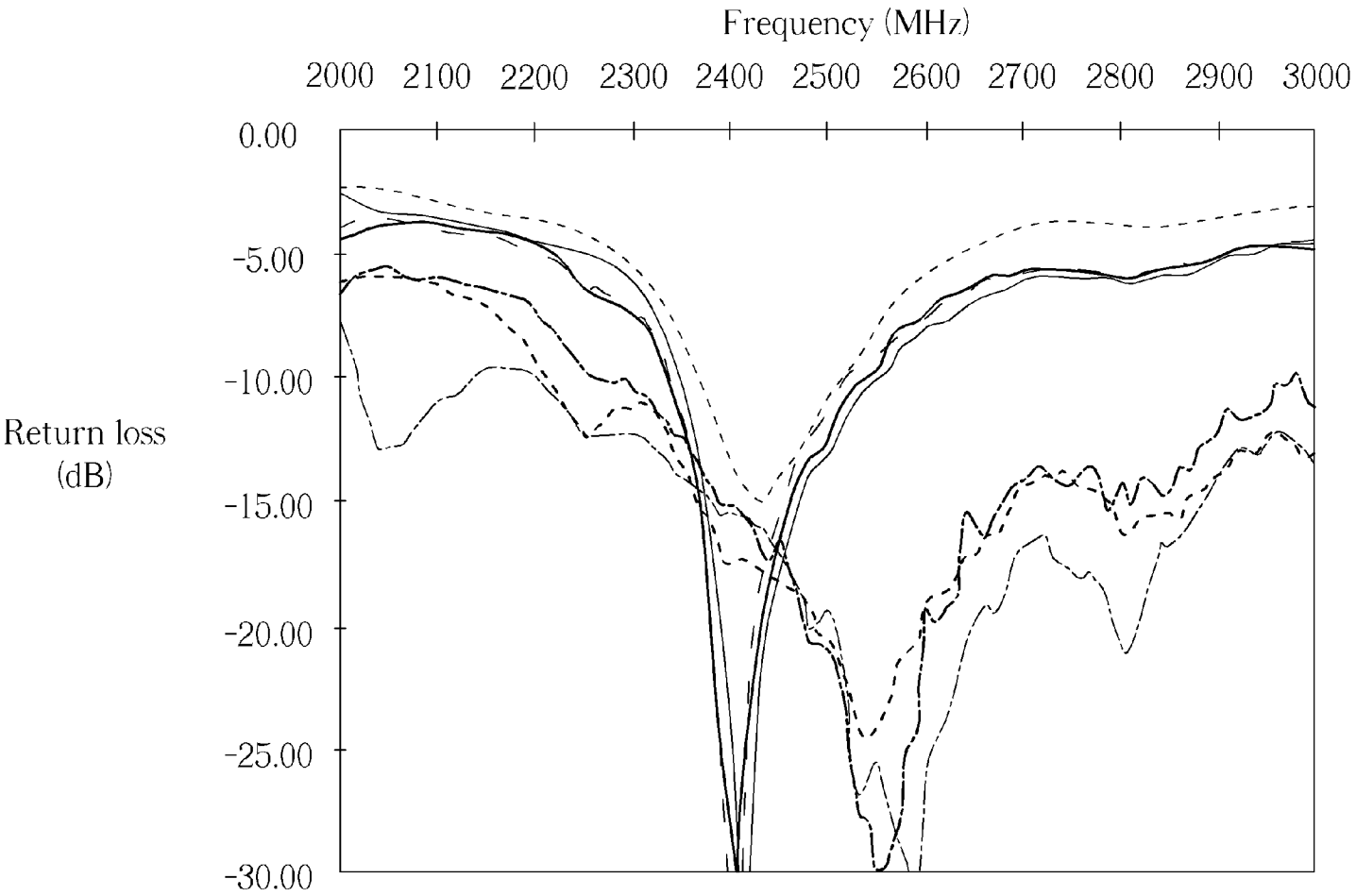
FIG. 7B is a schematic diagram illustrating antenna resonance simulation results of the switchable antenna of FIG. 5A.

Besides, the geometric structure of the switchable antenna 50 ensures resistance matching under both an omnidirectional mode and a directional mode. Specifically, when the switchable antenna 50 is operated in an omnidirectional mode, the upper surface bend sections 502, 504, 506 are all connected to the radio signal processing module 56. When the switchable antenna 50 is operated in a directional mode, only some of the upper surface bend sections 502, 504, 506 (such as the upper surface bend section 506) are connected to the radio signal processing module 56. However, because one of the upper surface bend sections (for example, the upper surface bend section 506) can be electrically connected to the corresponding lower surface bend section (i.e., the lower surface bend section 516) through the corresponding via (i.e., the via 586), and because the lower surface bend section (i.e., the lower surface bend section 516) can be electrically connected to the other lower surface bend sections (i.e., the lower surface bend sections 512, 514) through the center 511) and the corresponding upper surface bend sections (i.e., the upper surface bend sections 502, 504), when the switchable antenna 50 enters a directional mode to connect some of the upper surface bend sections 502, 504, 506 (i.e., the upper surface bend section 506) to the radio signal processing module 56, reverse currents are conducted in the other upper surface bend section(s) and the other lower surface bend section(s) (i.e., the upper surface bend sections 502, 504 and the lower surface bend sections 512, 514), thereby achieving resistance matching. For example, FIG. 7A is a schematic diagram illustrating current distribution of the switchable antenna 50 operated in a directional mode. FIG. 7B is a schematic diagram illustrating antenna resonance simulation results of the switchable antenna 50. In FIG. 7B, antenna resonance simulation results of the switchable antenna 50 operated in an omnidirectional mode are presented by a thin dotted line; return loss (scattering parameters S11) simulation results of the upper surface bend sections 502, 504, 506 are respectively presented by a thick dotted line, a thin dash-dotted line and a thick dash-dotted line; and antenna isolation simulation results of the upper surface bend sections 502, 504, 506 are respectively presented by a dashed line, a thick solid line and a thin solid line.

Figure 9C:
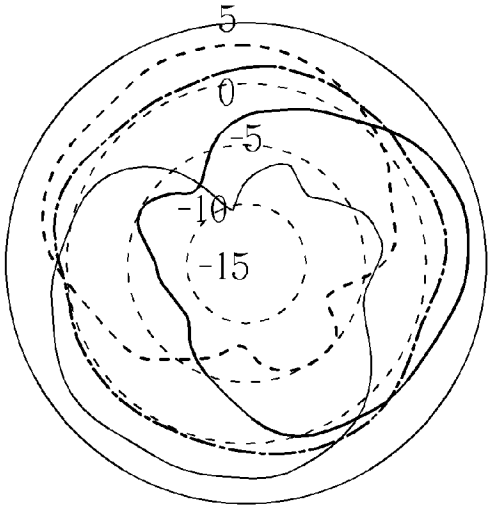
Figure 9B:
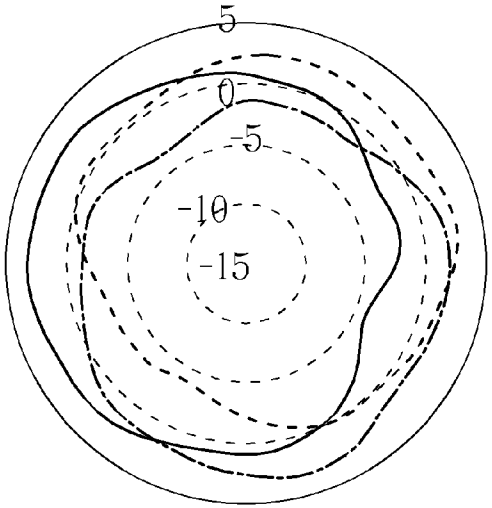
FIG. 9B is a schematic diagram illustrating antenna pattern characteristic measurement results for the switchable antenna of FIG. 5A measured at 60 degrees with merely one of the switch elements turned off.
Figure 9A:
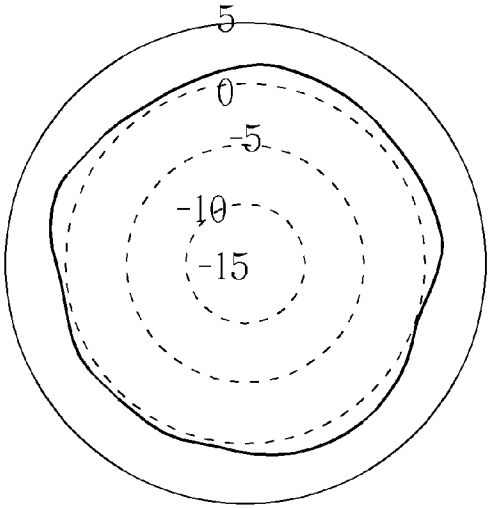
FIG. 9A is a schematic diagram illustrating antenna pattern characteristic measurement results for the switchable antenna of FIG. 5A measured at 60 degrees with the switch elements all turned off.

Simulation and measurement may be employed to determine whether radiation pattern of the switchable antenna 50 at different frequencies meets system requirements. In practical application, a vast metal plate is usually disposed below the switchable antenna 50 to provide shielding or other functions. However, the vast metal plate would cause the radiation pattern of the switchable antenna 50 to shift upward and thus generate a tilt angle. In order to properly present characteristics of the switchable antenna 50, the switchable antenna 50 can be sampled at 60 degrees (i.e., the elevation angle of 30 degrees from XY plane). Please refer to FIGS. 8A to 9C. FIG. 8A is a schematic diagram illustrating antenna pattern characteristic simulation results for the switchable antenna 50 operated at 2450 MHz and calculated at 60 degrees with the switch elements 532, 534, 536 all turned on. FIG. 8B is a schematic diagram illustrating antenna pattern characteristic simulation results for the switchable antenna 50 operated at 2450 MHz and calculated at 60 degrees with merely one of the switch elements 532, 534, 536 turned off. FIG. 8C is a schematic diagram illustrating antenna pattern characteristic simulation results for the switchable antenna 50 operated at 2450 MHz and calculated at 60 degrees with merely one of the switch elements 532, 534, 536 turned on. FIG. 9A is a schematic diagram illustrating antenna pattern characteristic measurement results for the switchable antenna 50 measured at 60 degrees with the switch elements 532, 534, 536 all turned on. FIG. 9B is a schematic diagram illustrating antenna pattern characteristic measurement results for the switchable antenna 50 measured at 60 degrees with merely one of the switch elements 532, 534, 536 turned off. FIG. 9C is a schematic diagram illustrating antenna pattern characteristic measurement results for the switchable antenna 50 measured at 60 degrees with merely one of the switch elements 532, 534, 536 turned on. As shown in FIG. 8A to 9C, when the number of the switch elements turned on drops, the beamwidth is less divergent.

Please note that the switchable antennas 10, 50 are exemplary embodiments of the invention, and those skilled in the art can make alternations and modifications accordingly. For example, a switch element of a switchable antenna may be of various kinds such as a diode and a transistor. The number of switch elements may vary with the number of upper surface bend sections and an upper surface bend section may correspond to a plurality of switch elements. The switchable antenna in the aforementioned embodiments comprises three upper surface bend sections and three lower surface bend sections; however, the present invention is not limited herein and a switchable antenna can comprise a plurality of upper surface bend sections and a plurality of lower surface bend sections. Alternatively, it is also possible that a switchable antenna merely comprises two upper surface bend sections and two lower surface bend sections. Besides, the upper surface bend sections 102, 104, 106 are substantially of rotational symmetry to evenly distribute the space between the upper surface bend sections 102, 104, 106. In such a situation, the corresponding lower surface bend sections 112, 114, 116 are symmetric with respect to rotations about the center 111. Likewise, the upper surface bend sections 502, 504, 506 are substantially of rotational symmetry to space evenly around, such that the corresponding lower surface bend sections 512, 514, 516 have rotational symmetry. Nevertheless, the present invention is not limited to this, and the configuration may be non-symmetrical, rectangle arranged and mirror symmetrical. Sizes of the antenna elements 122, 124, 126, the upper surface bend sections 102, 104, 106 and the lower surface bend sections 112, 114, 116 of the switchable antenna 10 may be respectively identical, and the upper surface bend sections 502, 504, 506 and the lower surface bend sections 512, 514, 516 of the switchable antenna 50 may also have the same size respectively, but not limited thereto—the exact size of each component is determined according to different system requirements or design considerations. Additionally, the antenna elements 122, 124, 126, the portions 522*a* to 526*c* of the adjustment elements 522, 524, 526, the portions 102*a* to 506*c* of the upper surface bend sections 102, 104, 106, 502, 504, 506 and the portions 112*a* to 516*e* of the lower surface bend sections 112, 114, 116, 512, 514, 516 are substantially linear, but the antenna elements, the upper surface bend sections and the lower surface bend sections can have the shape of a curve.

Figure 10:
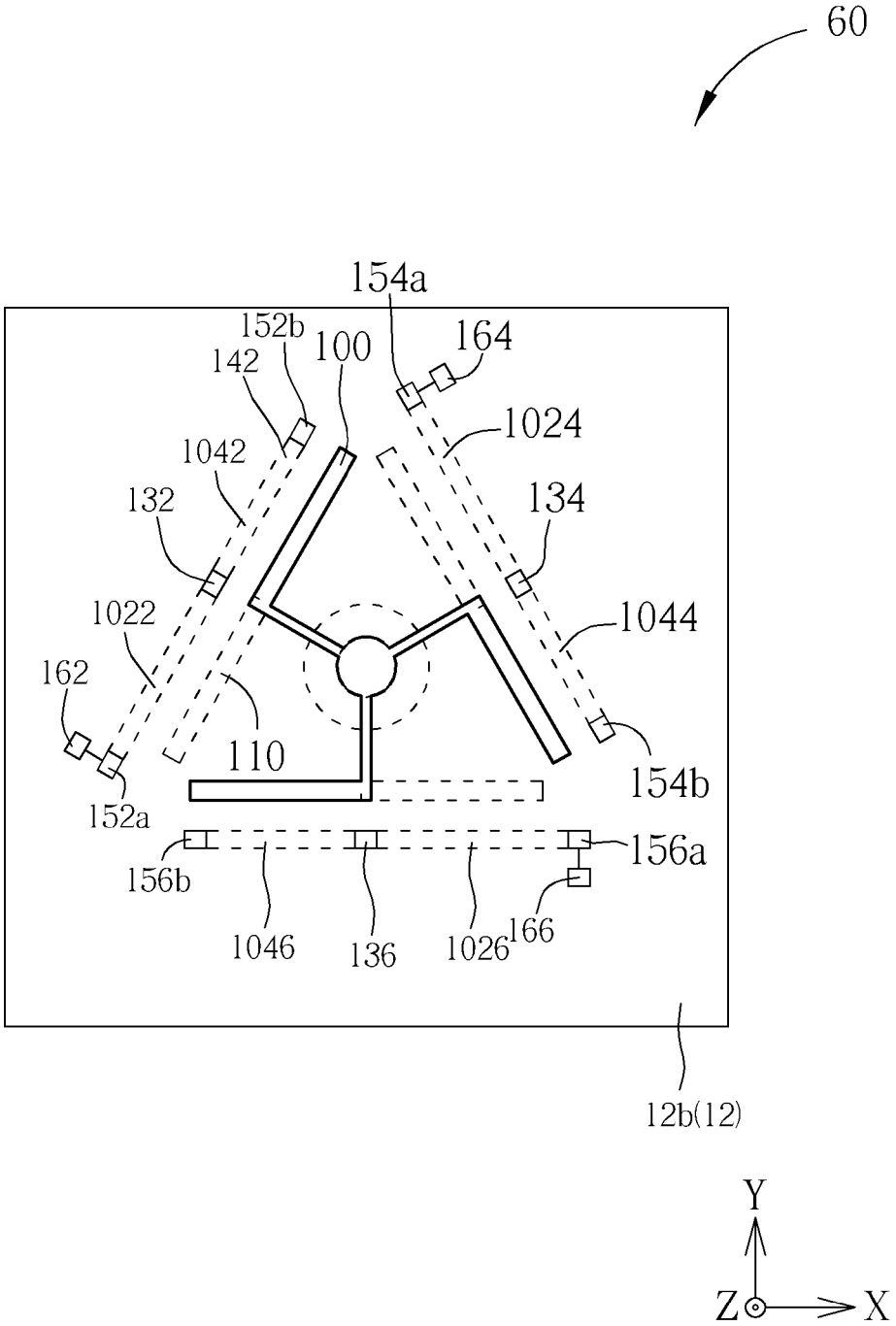
FIG. 10 is a schematic diagram illustrating a perspective view of a switchable antenna according to an embodiment of the present invention.

Furthermore, lengths of the antenna elements 122, 124, 126 of the switchable antenna 10 can be in a range of 0.4 to 0.475 times operating wavelength corresponding to the center frequency to increase bandwidth as a parasitic radiating element. However, if the switch elements 132, 134, 136 are not ideal switches and thus suffer effects of capacitance or inductance, when all of the switch elements 132, 134, 136 are turned off, currents can still flow through the switch elements 132, 134, 136, respectively. In this case, the antenna elements 122, 124, 126 may be properly adjusted according to system requirements. For example, please refer to FIG. 10. FIG. 10 is a schematic diagram illustrating a perspective view of a switchable antenna 60 according to an embodiment of the present invention. Since structure of the switchable antenna 60 is similar to that of the switchable antenna 10 in FIG. 1A, the same numerals and symbols denote the same components in the following description, and the identical parts are not detailed redundantly. As shown in FIG. 10, the switch elements 132, 134, 136 of the switchable antenna 60 are respectively disposed between antenna elements 1022, 1024, 1026 and extension sections 1042, 1044, 1046. The length of the antenna element 1022 is substantially equal to that of the extension section 1042, the length of the antenna element 1024 is substantially equal to that of the extension section 1044, and the length of the antenna element 1026 is substantially equal to that of the extension section 1046. Please note that length ratios of an antenna element to the corresponding extension section in the present invention is not limited thereto and may be adjusted according to characteristics of the corresponding switch element and equivalent lengths of the antenna element corresponding to the resonating radio-frequency signals. The configuration of an antenna element and the corresponding extension section may be appropriately modified as well. Furthermore, an upper surface bend section may form a clockwise bent structure while the corresponding lower surface bend section may form a counterclockwise bend structure. Alternatively, an upper surface bend section may form a counterclockwise bend structure while the corresponding lower surface bend section may form a clockwise bent structure correspondingly. Bend structure may be a bent L-shaped structure, for example but not limited thereto.

Figure 11:
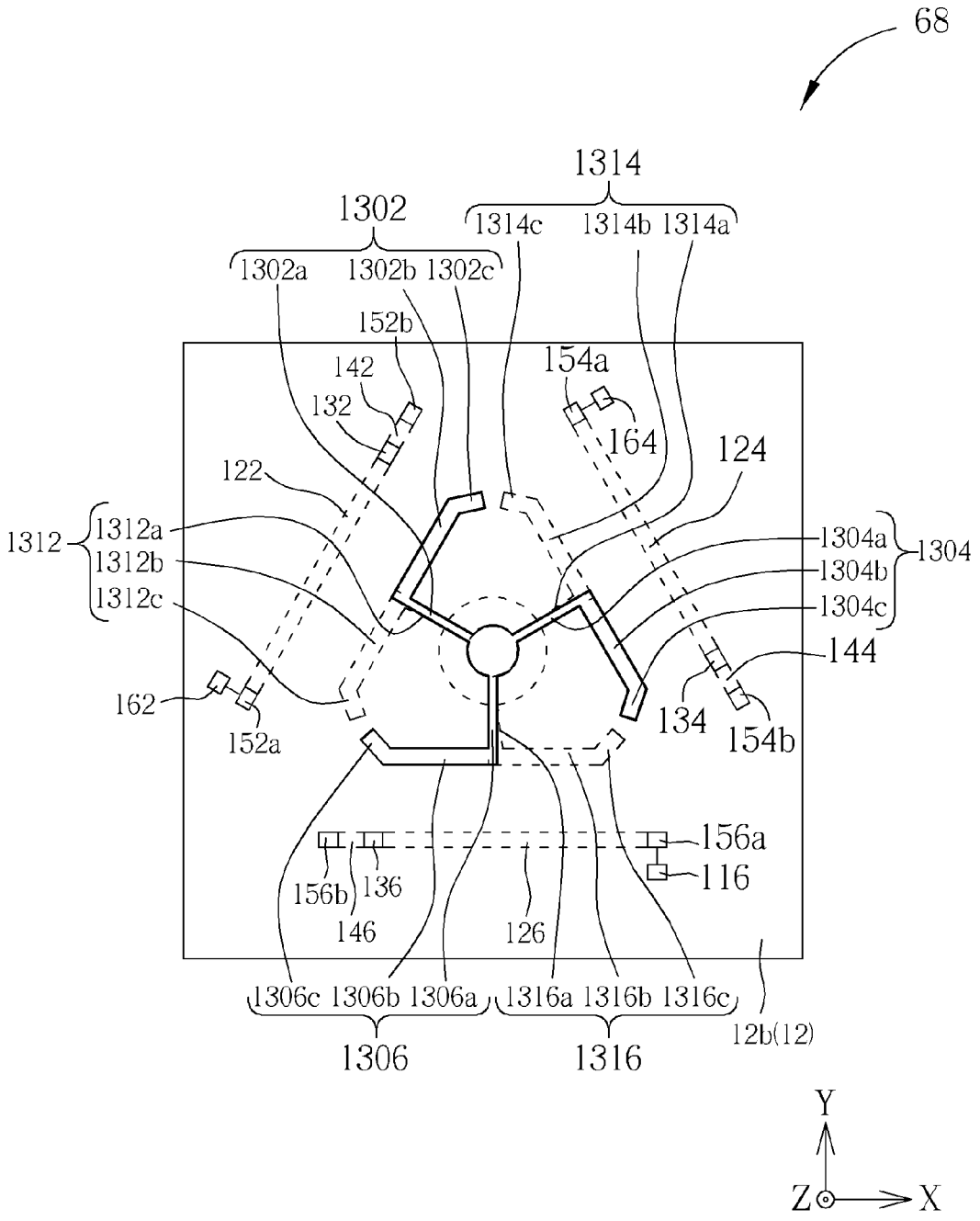
FIG. 11 is a schematic diagram illustrating a perspective view of a switchable antenna according to an embodiment of the present invention.

The number of portions constituting an upper surface bend section or a lower surface bend section is not limited to a specific number. For example, please refer to FIG. 11. FIG. 11 is a schematic diagram illustrating a perspective view of a switchable antenna 68 according to an embodiment of the present invention. Since structure of the switchable antenna 68 is similar to that of the switchable antenna 10 in FIG. 1A, the same numerals and symbols denote the same components in the following description. As shown in FIG. 11, an upper surface bend section 1302 comprises portions 1302*a*, 1302*b*, 1302*c*, an upper surface bend section 1304 comprises portions 1304*a*, 1304*b*, 1304*c*, and an upper surface bend section 1306 comprises portions 1306*a*, 1306*b*, 1306*c*. A lower surface bend section 1312 comprises portions 1312*a*, 1312*b*, 1312*c*, a lower surface bend section 1314 comprises portions 1314*a*, 1314*b*, 1314*c*, and a lower surface bend section 1316 comprises portions 1316*a*, 1316*b*, 1316*c*. Please note that width ratios or length ratios of portions of an upper surface bend section or a lower surface bend section and the manner that widths and lengths vary depend on different system requirements, and are not limited thereto.

Figure 12:
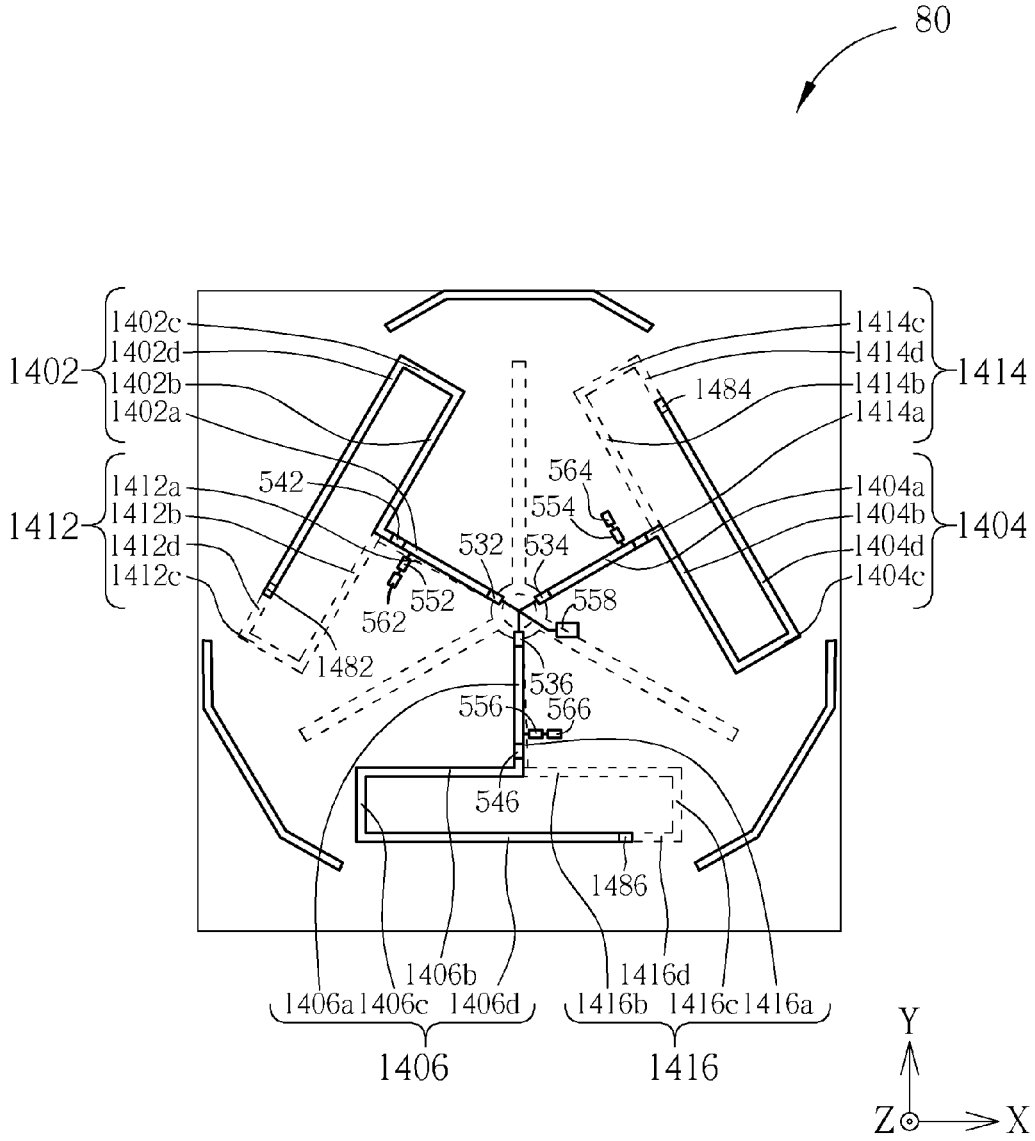
FIG. 12 is a schematic diagram illustrating a perspective view of a switchable antenna according to an embodiment of the present invention.

Structures of a lower surface bend section and an upper surface bend section of a switchable antenna can be properly adjusted, and configurations of a via vary correspondingly. For example, please refer to FIG. 12. FIG. 12 is a schematic diagram illustrating a perspective view of a switchable antenna 80 according to an embodiment of the present invention. Since structure of the switchable antenna 80 is similar to that of the switchable antenna 50 in FIG. 5A, the same numerals and symbols denote the same components in the following description. As shown in FIG. 12, an upper surface bend section 1402 comprises portions 1402*a* to 1402*d*, an upper surface bend section 1404 comprises portions 1404*a* to 1404*d*, and an upper surface bend section 1406 comprises portions 1406*a* to 1406*d*. A lower surface bend section 1412 comprises portions 1412*a* to 1412*d*, a lower surface bend section 1414 comprises portions 1414*a* to 1414*d*, and a lower surface bend section 1416 comprises portions 1416*a* to 1416*d*. Correspondingly, vias 1482, 1484, 1486 are respectively disposed between the upper surface bend sections 1402, 1404, 1406 and the lower surface bend sections 1412, 1414, 1416 to electrically connect the upper surface bend sections 1402, 1404, 1406 and the lower surface bend sections 1412, 1414, 1416.

Figure 13:
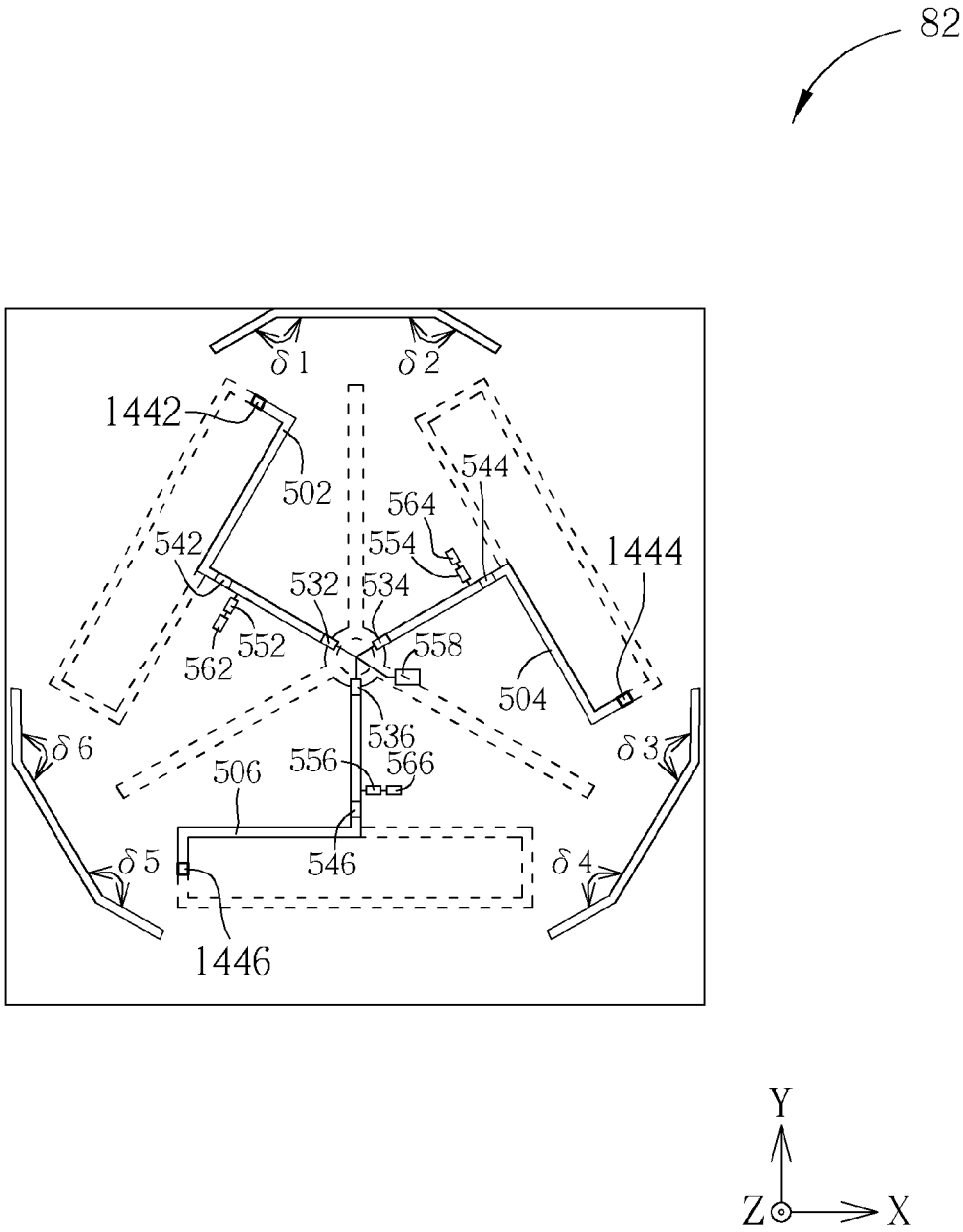
FIG. 13 is a schematic diagram illustrating a perspective view of a switchable antenna according to an embodiment of the present invention.
Figure 14:
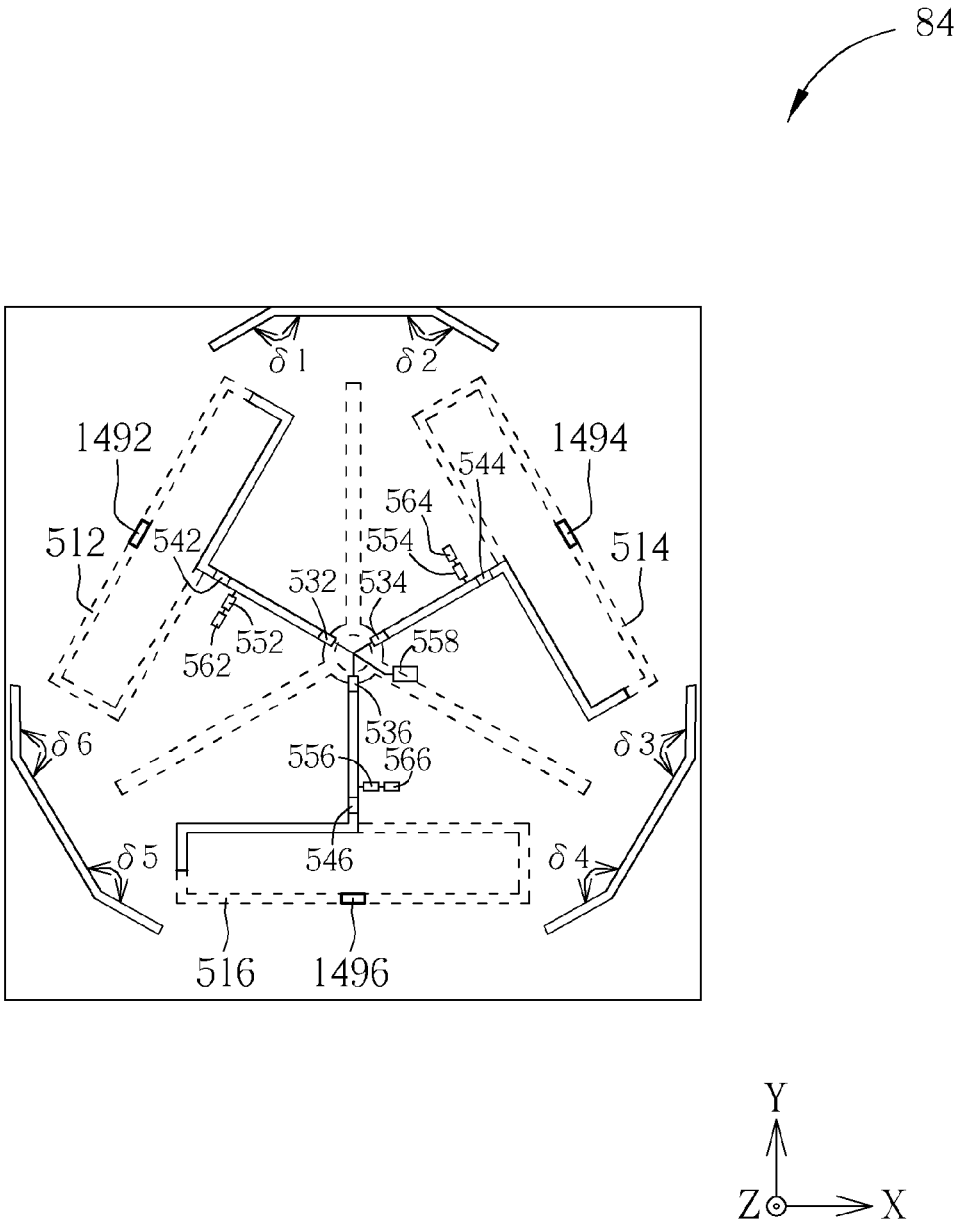
FIG. 14 is a schematic diagram illustrating a perspective view of a switchable antenna according to an embodiment of the present invention.

Besides, a direct current block of a switchable antenna may be disposed in any position between a choke and the center of a radiating portion. For example, please refer to FIG. 13. FIG. 13 is a schematic diagram illustrating a perspective view of a switchable antenna 82 according to an embodiment of the present invention. Since structure of the switchable antenna 82 is similar to that of the switchable antenna 50 in FIG. 5A, the same numerals and symbols denote the same components in the following description. As shown in FIG. 13, direct current blocks 1442, 1444, and 1446 are respectively disposed at ends of the upper surface bend sections 502, 504, 506. However, the present invention is not limited to these, for example, please refer to FIG. 14. FIG. 14 is a schematic diagram illustrating a perspective view of a switchable antenna 84 according to an embodiment of the present invention. Since structure of the switchable antenna 84 is similar to that of the switchable antenna 50 in FIG. 5A, the same numerals and symbols denote the same components in the following description. As shown in FIG. 14, direct current block 1492, 1494, 1496 are respectively disposed within the lower surface bend sections 512, 514, 516.

Geometric structures of the adjustment elements 522, 524, 526 of the switchable antenna 50 may be properly adjusted according to system requirements. For example, the number of portions of the adjustment elements 522, 524, 526 is not limited to 3, and the adjustment elements 522, 524, 526 may respectively comprise a plurality of portions to enhance antenna gain around boundary of radiation pattern under a directional mode, thereby broadening beamwidth and eliminating dead zones. Moreover, enclosed angles enclosed by portions and width ratios or length ratios of the portions may also be adjusted correspondingly, which are not detailed redundantly. Similarly, the number of portions of an upper surface bend section and a lower surface bend section may be properly adjusted according to system requirements. For example, the upper surface bend sections 502, 504, 506 and the lower surface bend sections 512, 514, 516 may respectively comprise a plurality of portions such that the upper surface bend sections 502, 504, 506 and the lower surface bend sections 512, 514, 516 respectively form a closed folded dipole antenna structure. Please note that width ratios or length ratios of portions of an upper surface bend section or a lower surface bend section and the manner that widths and lengths vary depend on different system requirements, and are not limited thereto.

Figure 15:
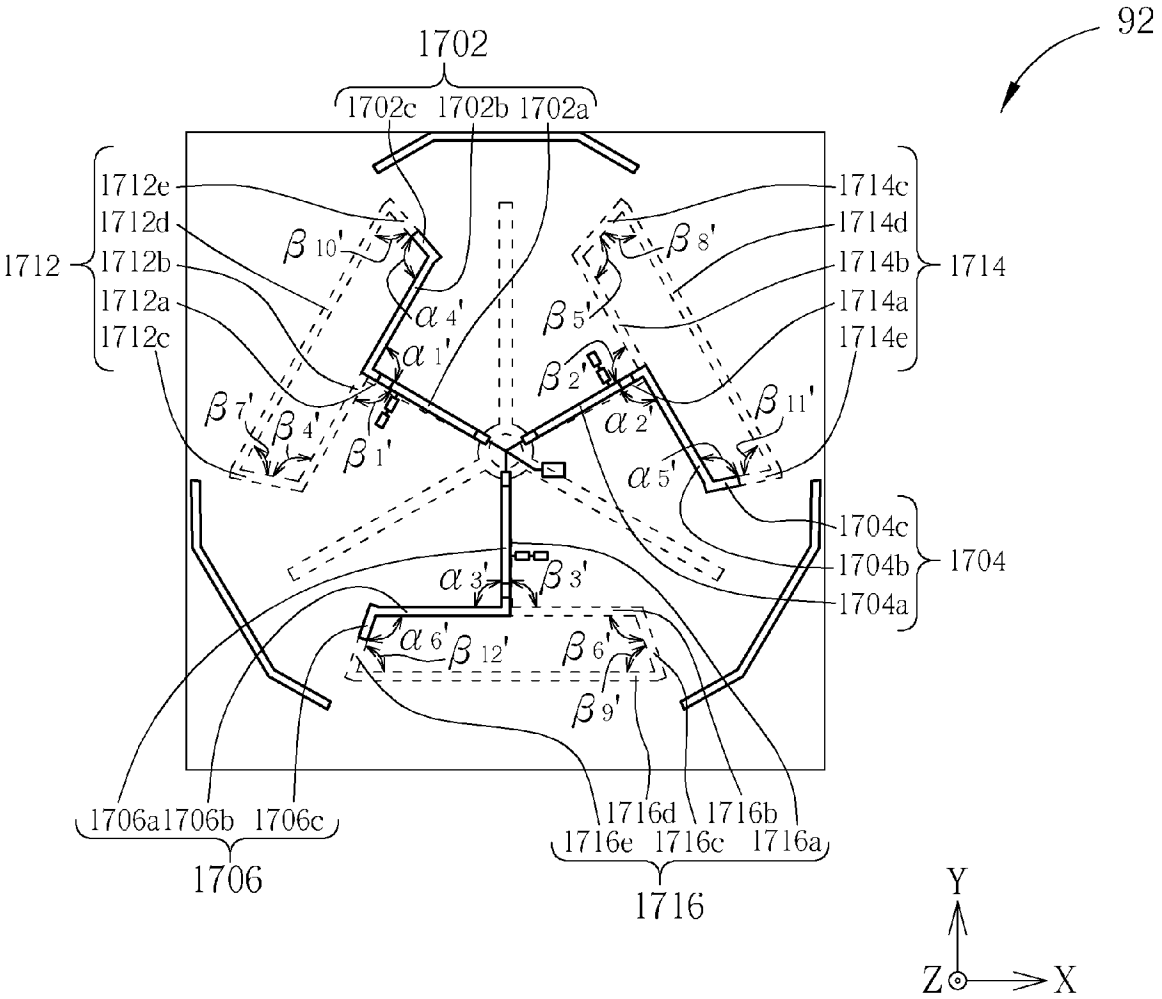
FIG. 15 is a schematic diagram illustrating a perspective view of a switchable antenna according to an embodiment of the present invention.

An enclosed angle enclosed by portions of an upper surface bend section or a lower surface bend section may be appropriately modified according to system requirements. For example, please refer to FIG. 15. FIG. 15 is a schematic diagram illustrating a perspective view of a switchable antenna 92 according to an embodiment of the present invention. Since structure of the switchable antenna 92 is similar to that of the switchable antenna 10 in FIG. 1A, the same numerals and symbols denote the same components in the following description. As shown in FIG. 15, an enclosed angle $\alpha_4'$ enclosed by portions 1702*b*, 1702*c* of an upper surface bend section 1702 is greater than 90 degrees, an enclosed angle $\alpha_5'$ enclosed by portions 1704*b*, 1704*c* of an upper surface bend section 1704 is greater than 90 degrees, and an enclosed angle $\alpha_6'$ enclosed by portions 1706*b*, 1706*c* of an upper surface bend section 1706 is greater than 90 degrees. An enclosed angle $\beta_4'$ enclosed by portions 1712*b*, 1712*c* of a lower surface bend section 1712 is greater than 90 degrees, an enclosed angle $\beta_7'$ enclosed by portions 1712*c*, 1712*d* and an enclosed angle $\beta_{10}'$ enclosed by portions 1712*d*, 1712*e* are less than 90 degrees, an enclosed angle $\beta_5'$ enclosed by portions 1714*b*, 1714*c* of a lower surface bend section 1714 is greater than 90 degrees, an enclosed angle $\beta_8'$ enclosed by portions of the portions 1714*c*, 1714*d* and an enclosed angle $\beta_{11}'$ enclosed by portions 1714*d*, 1714*e* are less than 90 degrees, an enclosed angle $\beta_6'$ enclosed by portions 1716*b*, 1716*c* of a lower surface bend section 1716 is greater than 90 degrees, and an enclosed angle $\beta_9'$ enclosed by portions 1716*c*, 1716*d* and an enclosed angle $\beta_{12}'$ enclosed by portions of 1716*d*, 1716*e* are less than 90 degrees. Therefore, the upper surface bend sections 1702, 1704, 1706 and the lower surface bend sections 1712, 1714, and 1716 respectively form a closed folded dipole antenna structure.

To sum up, by controlling switch elements, a switchable antenna can be operated in an omnidirectional mode or a directional mode. With antenna elements or reflection sections, directivity of the switchable antenna can be adjusted to avoid interference.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A switchable antenna, configured to transmit and receive radio-frequency signals, comprising:

a substrate, comprising an upper surface and a lower surface;

a first radiating portion, formed on the upper surface of the substrate, and comprising a first center, a first bend section and a second bend section respectively extending from the first center;

a second radiating portion, formed on the lower surface of the substrate, and comprising a second center, a third bend section and a fourth bend section respectively extending from the second center, wherein the third bend section and the fourth bend section are disposed corresponding to the first bend section and the second bend section, respectively;

a first antenna element, disposed on the upper surface and corresponding to the first bend section;

a first switch element, electrically connected to the first antenna element, and configured to switch the first antenna element between a reflector and a parasitic radiating element;

a second antenna element, disposed on the upper surface and corresponding to the second bend section; and a second switch element, electrically connected to the second antenna element, and configured to switch the second antenna element between a reflector and a parasitic radiating element.

2. The switchable antenna of claim 1, wherein the first switch element and the second switch element are turned off under an omnidirectional mode, and the first antenna element and the second antenna element respectively serve as a parasitic radiating element.

3. The switchable antenna of claim 1, wherein either the first switch element or the second switch element is turned on to serve as a reflector under a directional mode.

4. The switchable antenna of claim 1, wherein the second center and the first center are aligned along a vertical projection direction, the first bend section and the third bend section form a first T-shaped structure along the vertical projection direction, and the second bend section and the fourth bend section form a second T-shaped structure along the vertical projection direction.

5. The switchable antenna of claim 1, further comprising:

a first choke, coupled to the first antenna element;

a first extension section, coupled to the first switch element;

a second choke, coupled between a control module and the first extension section;

a first resistor, coupled between a system ground and the first choke;

a third choke, coupled to the second antenna element;

a second extension section, coupled to the second switch element;

a fourth choke, coupled between the control module and the second extension section; and a second resistor, coupled between the system ground and the third choke;

wherein the control module is configured to selectively turn on the first switch element or the second switch element.

6. A switchable antenna, configured to transmit and receive radio-frequency signals, comprising:

a substrate, comprising an upper surface and a lower surface;

a first radiating portion, formed on the upper surface of the substrate, and comprising:

a first bend section; and a second bend section;

a second radiating portion, formed on the lower surface of the substrate, and comprising:

a center;

a third bend section, extending from the center, and electrically connected to the first bend section through a first via, and disposed corresponding to the first bend section; and a fourth bend section, extending from the center, and electrically connected to the second bend section through a second via, and disposed corresponding to the second bend section;

a first switch element, configured to control a connection between the first bend section and a radio signal processing module; and a second switch element, configured to control a connection between the second bend section and the radio signal processing module;

wherein the third bend section and the first bend section form a first folded dipole antenna structure, and the fourth bend section and the second bend section form a second folded dipole antenna structure.

7. The switchable antenna of claim 6, wherein the first switch element and the second switch element are turned on under an omnidirectional mode, signals are transmitted between the radio signal processing module and the first bend section, and between the radio signal processing module and the second bend section.

8. The switchable antenna of claim 6, wherein either the first switch element or the second switch element is turned off under a directional mode.

9. The switchable antenna of claim 6, further comprising:

a first choke, coupled to the first bend section;

a first resistor, coupled between a control module and the first choke;

a first direct current block, disposed within the first bend section;

a second choke, coupled to the second bend section;

a second resistor, coupled between the control module and the second choke;

a second direct current block, disposed within the second bend section; and a third choke, coupled between the first switch element, the second switch element and system ground;

wherein the control module is configured to selectively turn on the first switch element or the second switch element.

10. The switchable antenna of claim 6, wherein the second radiating portion further comprises:

a first reflection section, extending from the center and disposed between the third bend section and the fourth bend section; and a second reflection section, extending from the center and disposed corresponding to the first reflection section.

11. The switchable antenna of claim 10, further comprising:

a first adjustment element, formed on the upper surface, disposed corresponding to the first reflection section, and configured to adjust beamwidth; and a second adjustment element, formed on the upper surface, disposed corresponding to the second reflection section, and configured to adjust beamwidth.

12. The switchable antenna of claim 6, wherein the first via and the second via are disposed within the substrate.

* * * * *